US007396504B2

(12) United States Patent
Kodama et al.

(10) Patent No.: US 7,396,504 B2
(45) Date of Patent: Jul. 8, 2008

(54) METHOD FOR SUPPLYING MOLTEN METAL, SYSTEM FOR SUPPLYING MOLTEN METAL, PRODUCING METHOD FOR PRODUCING ALUMINUM, PRODUCING METHOD FOR PRODUCING ALUMINUM MOLDING PRODUCT, PRODUCING METHOD OF AUTOMOBILE, TRANSPORTING VEHICLE, CONTAINER, AND APPARATUS FOR SUPPLYING MOLTEN METAL

(75) Inventors: Toru Kodama, Aichi (JP); Tsuyoshi Abe, Aichi (JP); Hiroshi Mizuno, Aichi (JP); Kazunori Suzuki, Aichi (JP); Kouji Iyoda, Aichi (JP); Kenji Noguchi, Aichi (JP)

(73) Assignee: Hoei Shokai Co., Ltd., Aichi (JP)

( * ) Notice: Subject to any disclaimer, the term of this patent is extended or adjusted under 35 U.S.C. 154(b) by 177 days.

(21) Appl. No.: 10/312,001

(22) PCT Filed: Jun. 22, 2001

(86) PCT No.: PCT/JP01/05375

§ 371 (c)(1),
(2), (4) Date: Jun. 19, 2003

(87) PCT Pub. No.: WO01/98004

PCT Pub. Date: Dec. 27, 2001

(65) Prior Publication Data

US 2004/0089987 A1 May 13, 2004

(30) Foreign Application Priority Data

Jun. 22, 2000 (JP) ..... 2000-188522
Feb. 14, 2001 (JP) ..... 2001-037159

(51) Int. Cl.
*C21C 5/42* (2006.01)

(52) U.S. Cl. ..... 266/239; 222/595

(58) Field of Classification Search ..... 266/236, 266/239; 222/595
See application file for complete search history.

(56) References Cited

U.S. PATENT DOCUMENTS 3,321,116 A * 5/1967 Loftin ..... 222/595
5,271,539 A * 12/1993 Ozawa et al. ..... 222/595

FOREIGN PATENT DOCUMENTS

| | | |
|---|---|---|
| EP | 0 252 318 A1 | 1/1988 |
| EP | 252318 | 1/1988 |
| JP | 51-123725 A1 | 10/1976 |
| JP | 57-26384 | 2/1982 |

(Continued)

*Primary Examiner*—Scott Kastler
(74) *Attorney, Agent, or Firm*—Rader, Fishman & Grauer, PLLC

(57) ABSTRACT

The present invention comprises a sealed type container body (50) capable of storing molten metal; a flow passage (57) capable of flowing the molten metal, the passage is formed extended to an outside of the container, and the passage is formed towards an upper portion (57*b*) from an opening (57*a*) provided at a position on an inner and near a bottom portion (50*a*) of the container body (50); and means (101, 0313) for controlling the pressure in the container body. This makes it possible to provide a container or the like requiring no replacement of parts such as a stoke and the like.

4 Claims, 16 Drawing Sheets

FOREIGN PATENT DOCUMENTS

| | | | |
|---|---|---|---|
| JP | 57-26384 | A1 | 2/1982 |
| JP | 57-76970 | U | 10/1982 |
| JP | 02-052164 | A1 | 2/1990 |
| JP | 2-307658 | | 12/1990 |
| JP | 02-307658 | A1 | 12/1990 |
| JP | 03-31063 | U | 3/1991 |
| JP | 31063/1991 | | 3/1991 |
| JP | 4-100672 | | 4/1992 |
| JP | 04-100672 | A1 | 4/1992 |
| JP | 05-293634 | A1 | 11/1993 |
| JP | 07-178515 | A1 | 7/1995 |
| JP | 08-174197 | A1 | 7/1996 |
| JP | 9-38765 | | 2/1997 |
| JP | 09-038765 | A1 | 2/1997 |
| JP | 10-277726 | | 10/1998 |
| JP | 10-277726 | A1 | 10/1998 |
| JP | 11-28560 | | 2/1999 |
| JP | 11-028560 | A1 | 2/1999 |
| JP | 11-188475 | | 7/1999 |
| JP | 11-188475 | A1 | 7/1999 |

* cited by examiner

METHOD FOR SUPPLYING MOLTEN METAL, SYSTEM FOR SUPPLYING MOLTEN METAL, PRODUCING METHOD FOR PRODUCING ALUMINUM, PRODUCING METHOD FOR PRODUCING ALUMINUM MOLDING PRODUCT, PRODUCING METHOD OF AUTOMOBILE, TRANSPORTING VEHICLE, CONTAINER, AND APPARATUS FOR SUPPLYING MOLTEN METAL

TECHNICAL FIELD

The present invention relates to a method for supplying a molten metal used for carrying, for example, molten aluminum, a system for supplying a molten metal, a producing method for producing a molten aluminum, a producing method for producing an aluminum molding product, a producing method of an automobile, a transporting vehicle, a container, and an apparatus for supplying a molten metal.

BACKGROUND ART

In a factory where aluminum is molded using many die-casting machines, an aluminum material is often supplied not only from within the factory but also from outside the factory. In this case, a container storing aluminum in a melt is carried from a factory on the material supply side to a factory on the molding side to supply to each of the die-casting machines the material kept in the melt.

DISCLOSURE OF THE INVENTION

The present inventors propose a technique of supplying the molding material from such a container to the die-casting machine side utilizing a pressure difference. More specifically, this technique applies a pressure to the container to pour a molten material in the container to the outside through a pipe led to the container. As such a container, it is possible to use, for example, an apparatus disclosed in Japanese Patent Laid-Open No. Hei 8-20826.

The apparatus disclosed in Japanese Patent Laid-Open No. Hei 8-20826, however, has a problem that since its stoke is kept exposed to the molten metal in the container, there often occurs a necessity to replace the oxidized and corroded stoke. Besides, when such a container is carried between factories, the inside of the container is first preheated using a gas burner or the like, and then the molten material is supplied into the container. The apparatus disclosed in Japanese Patent Laid-Open No. Hei 8-20826 has another problem that the stoke needs to be removed together with a large lid for holding the stoke for preheating because the stoke in the container is an obstacle during the preheating, leading to a very low productivity.

In addition, a series of systems for supplying such molten aluminum has a problem that the molten aluminum at a high temperature often comes into contact with air, the aluminum is oxidized by ambient air. Such slag (oxide) is a problem affecting the quality of the aluminum, and an operator thus usually strains it out from the surface of the molten aluminum in a tandish (container) through a sprue gate of the tandish. Therefore, improvements in productivity have been required, and, more than that, the above straining work has sometimes been of little use for removal of the oxide from the tandish.

The present invention is made to solve the above-described problems, and its object is to provide a technique of requiring no replacement of parts such as a stoke and the like.

It is another object of the present invention to provide a technique capable of efficiently performing preheating.

It is still another object of the present invention to provide a technique of eliminating the above-described work of removing oxide to improve productivity.

To solve the above problems, a container of the present invention is characterized by comprising a sealed type container body capable of storing molten metal; a flow passage capable of flowing the molten metal, the passage is formed extended to an outside of the container, and the passage is formed towards an upper portion from an opening provided at a position on an inner and near a bottom portion of the container body; and means for controlling the pressure in the container body.

In the present invention, the flow passage for flowing the molten metal is configured to extend to the outer periphery of the container body and toward the upper portion from the position on the inner and near the bottom portion of the container body. In other words, in the present invention, as compared to the apparatus disclosed in Japanese Patent Laid-Open No. Hei 8-20826, members such as the stoke and the like which are exposed to the molten metal in the container become unnecessary, thus eliminating the necessity to replace the parts such as the stoke and the like. In addition, in the present invention, no member such as the stoke which obstructs preheating is disposed in the container to improve the productivity for preheating, thus enabling efficient preheating.

Here, a method for supplying a molten metal using a container according to the present invention is characterized by comprising the steps of (a) reducing a pressure in a container so that the molten metal is loaded into the container from outside of the container; and (b) supplying the molten metal from the container to the outside of the container. Here, the reducing a pressure in a container means that the pressure outside the container>the pressure inside the container. This state includes, in addition to the case of reducing the pressure in the container, a case of applying a pressure to the outside of the container, and further a case of reducing the pressure in the container and applying a pressure to the outside of the container.

The above-described loading of the molten metal into the container utilizing the pressure difference between the inside and the outside of the container only requires that a furnace for supplying the molten metal is connected to the container through a member in the shape of drawing the molten metal into the container, for example, a pipe. It becomes unnecessary to connect the furnace for supplying the molten metal to the container through, for example, a tub member, so that the possibilities of the molten metal coming into contact with air lessen remarkably, thus making it possible to decrease as much as possible oxidation of the molten metal supplied into the container. Therefore, it becomes possible to eliminate the work of removing oxide for improved productivity, and additionally to supply molten metal including little or no oxide. Further, it is also possible to degas a gas component such as hydrogen resolved in the molten metal. Such a gas component reduces productivity in a die-casting step.

The step (b) is characterized by applying the positive pressure to the container so that the molten metal is supplied from the container to the outside of the container. For example, it is characterized that the container having a first pipe connecting inside and the outside of the container capable of flowing the molten metal, and the molten metal is passing through the first pipe in the step (a) and step (b).

The applying the positive pressure to the container means that the pressure inside the container>the pressure outside the container. This state includes, in addition to the case of applying the positive pressure to the container, a case of reducing the pressure outside of the container, and further a case of applying the positive pressure to the container and reducing the pressure outside of the container.

In the present invention, the molten metal can be supplied from the furnace for supplying the molten metal into the container and supplied from the container to a server using, for example, the common first pipe, so that the configuration can be very simplified. The present invention, however, also includes a case in which the molten metal is loaded and supplied through different pipes.

The method for supplying a molten metal of the present invention is characterized in that the container having a second pipe connecting the inside and the outside of the container, and the pressure in the container is reduced and applied through the second pipe in the step (a) and step (b). The pressure in the container is reduced and applied through the common pipe as described above enables the configuration of the container to be very simple.

Therefore, in the present invention, it becomes possible to load the molten metal into the container and supply the molten metal from the container only by providing, for example, the first and the second pipe for the container. This makes it possible not only to simplify the configuration but also to decrease remarkably oxidation of the molten metal.

The method for supplying a molten metal of the present invention is characterized in that the step (a) further comprises, reducing a pressure in the container so that the molten metal is loaded into the container from the outside of the container; detecting a level of the molten metal; and controlling a pressure in the container according to the detected level of the molten metal. This makes it possible to supply a proper amount of the molten metal into the container irrespective of, for example, the system configuration on the server side.

The method for supplying a molten metal of the present invention is characterized in that the step (a) further comprises the step of purging a space inside the container with a non-oxidizing gas after the molten metal is loaded. This makes it possible to further suppress oxidation of the molten metal supplied into the container.

The method for supplying a molten metal of the present invention is characterized in that the container having a first pipe connecting inside and the outside of the container capable of flowing the molten metal, and an effective inner diameter of the first pipe is about 65 mm to about 85 mm.

A system for supplying a molten metal of the present invention is characterized by comprising a container capable of storing the molten metal; a pipe capable of flowing the molten metal, and the first pipe connecting inside and outside of the container; and an exhausting system for exhausting the inside of the container. Further, the system for supplying a molten metal of the present invention is characterized by comprising a container capable of storing the molten metal; a first pipe capable of flowing the molten metal, and the first pipe connecting inside and outside of the container; and a second pipe connecting the inside and the outside of the container, and the second pipe capable of reducing a pressure inside of the container.

In the present invention, it is only required that a furnace for supplying the molten metal is connected to the container through a pipe for drawing the molten metal into the container, so that the possibilities of the molten metal coming into contact with air lessen remarkably, thus making it possible to decrease as much as possible oxidation of the molten metal supplied into the container. Therefore, it becomes possible to eliminate the work of removing oxide for improved productivity, and additionally to supply molten metal including little or no oxide.

The system for supplying a molten metal of the present invention is characterized in that the effective inner diameter of the pipe for flowing the molten metal is about 65 mm to about 85 mm.

The system for supplying a molten metal of the present invention is characterized in that an inner opening of the pipe is formed at an inner lower portion of the container. Thereby, most of the molten metal to be supplied into the container through the pipe is supplied below the surface of the molten metal which has already been supplied into the container, that is, most of the molten metal to be supplied through the pipe is prevented from coming into contact with air in the container during the supply, so that oxidation of the molten metal can be effectively prevented. Further, the opening of the pipe is disposed at such a position, thereby enabling supply of the molten metal from the container to a server by application of a pressure through use of the pipe. In a container of a type of supplying the molten metal to the outside by a differential pressure, when the pipe clogs, the molten metal in the container cannot be supplied, resulting in solidified metal. The container of the present invention has an advantage that even when the pipe attached to the container clogs because of some circumstances, the molten metal can be supplied to the outside by detaching this pipe and tilting the container like a teapot.

The system for supplying a molten metal of the present invention is characterized by further comprising means for detecting a level or a weight of the molten metal; and means for controlling the exhaustion system according to the detected level or weight of the molten metal. This enables supply of a proper amount of the molten metal into the container. The means for detecting a level is characterized by comprising a pair of electrodes which are provided on a ceiling portion of the inside of the container with a predetermined distance therebetween, with tip portions thereof projecting at least to a position of a maximum level in the container. The use of such means for detecting a level enables detection of the level with a simple configuration also in an environment at a high temperature causing the metal to melt. The means for detecting a level may be used together with, for example, a weight sensor. For example, it is adoptable that the amount of the molten metal in the container is measured using the weight sensor in normal times, and the means for detecting a level with the above-described configuration is used as means for detecting a maximum level for emergency. This enables construction of a safer system.

A system for supplying a molten metal of the present invention is characterized by comprising loading a molten metal into the container by reducing a pressure in the container and transporting the container to at least a use point; and supplying the molten metal at the use point by applying the positive pressure to the container. Here, the present invention is characterized in that the molten metal is, for example, aluminum, the container is transported to the use point through a public road, and molding procuct using the molten aluminum is performed at the use point.

The present invention is a producing method for producing a molten aluminum from a solid aluminum characterized by comprising the steps of melting the solid aluminum in a furnace; connecting the furnace and a container with a pipe; and reducing a pressure in the container so that the molten aluminum is loaded into the container through the pipe. This enables production of molten aluminum containing little oxide.

A producing method for producing an aluminum molding product produced by die-casting of the present invention is characterized by comprising the steps of melting an aluminum in a furnace; connecting the furnace and a container with a pipe; reducing a pressure in the container so that the molten aluminum is loaded into the container through the pipe; applying a pressure to the container so that the molten aluminum is supplied into a server through the pipe; and supplying the molten aluminum to an aluminum die-casting machine to produce the aluminum molding product. This enables efficient production of a high quality aluminum molding product with little oxide.

A producing method of an automobile of the present invention is characterized by comprising the steps of melting an aluminium in a furnace; connecting the furnace and a container with a pipe; reducing a pressure in the container so that the molten aluminum is loaded into the container through the pipe; applying a pressure to the container so that the molten aluminum is supplied into a server through the pipe; and supplying the molten aluminum to an aluminum die-casting machine from the server to produce an engine for an automobile; and assembling the automobile using the engine. This enables efficient production of an automobile with a high quality engine with little oxide.

A system for supplying a molten metal of the present invention is characterized by comprising a container capable of supplying a molten metal by applying a positive pressure to the container; a lifting mechanism capable of holding the container, and raising and lowering with holding the container; a transporting vehicle having a tank, and the tank supplies a gas for applying the positive pressure to the container.

A transporting vehicle of the present invention is characterized by comprising a lifting mechanism capable of holding a container and raising and lowering with holding the container; a container capable of supplying a molten metal by applying a positive pressure to the container.

According to the present invention, the tank for applying the positive pressure to the container is mounted on the transporting vehicle, and the gas for applying the positive pressure is supplied from the tank into the container capable of supplying a molten metal by applying a positive pressure to the container to feed the molten metal by the pressure with this gas, thus eliminating the necessity to tilt the container as before. Therefore, for example, a rotation mechanism does not need to be provided on a fork lift truck, but only the lifting mechanism needs to be provided, resulting in a very simple mechanism. In addition, since the tank supplying a gas for applying the positive pressure is used as means for applying a pressure, for example, installation of a power generator which is considered as required when a compressor is mounted becomes unnecessary, leading to a reduction in size and weight. In a factory, replenishing gas is also very easy.

The aforementioned transporting device may be provided with means for measuring (for example, a pressure gauge) provided at a fork portion of a fork lift mechanism, for measuring the weight of the container, and means for controlling for controlling the supply of the gas from the tank supplying a gas for applying the positive pressure to the container based on the measurement result.

According to the configuration, when the weight of the container becomes equal to or less than a predetermined value, which indicates that a predetermined amount of the molten metal already supplied from the container to the receiver side, the supply of the gas is stopped to stop the supply of the molten metal. This enables a specified amount of the molten metal to be supplied without manpower but with a simple configuration.

A supply apparatus of the present invention comprises a hermetic zone means for supplying metal into the hermetic zone; means for receiving the supplied metal, in the hermetic zone; and means for controlling the oxygen concentration in the hermetic zone.

The supply apparatus of the present invention comprises a furnace capable of holding and retaining heat in, or heating, the molten metal; a pipe for leading the molten metal into an hermetic chamber; means for controlling the oxygen concentration in the furnace and the hermetic chamber; and means for controlling the difference between the pressure in the furnace and the pressure in the hermetic chamber.

Further, the supply apparatus of the present invention comprises a furnace capable of holding and retaining heat in, or heating, the molten metal; a pipe for leading the molten metal into an hermetic chamber; and means for controlling the pressure in the furnace to be relatively higher than the pressure in the hermetic chamber to supply the molten metal to a use point. The supply apparatus may further comprise means for controlling the pressure in the furnace to be relatively lower than the pressure in the use point to return the molten metal into the furnace.

The supply method of the present invention passes the molten metal in the hermetice zone in which the oxygen concentration or the oxygen activity is controlled.

A method for producing a metal product of the present invention comprises the steps of supplying a molten metal in an hermetic zone in which the oxygen concentration is controlled; and molding the supplied metal.

The control of the oxygen concentration or the oxygen activity is conducted so that oxidation of the metal is suppressed. The control of the oxygen concentration can be conducted not only by controlling the oxygen partial pressure but also by controlling the total pressure. Further, it is also adoptable to conduct control including temperature. Hereafter, a case only referring to the oxygen concentration shall include the concept of the oxygen activity. Depending on conditions of temperature, pressure, oxygen concentration, and so on, not only oxidation of the metal is suppressed but also the metal is sometimes deoxidized. In either case, the metal is supplied to the use point in the hermetic zone while oxidation thereof being suppressed. The metal to be supplied here includes, for example, metal in a melt or metal powder (including fine particles and ultra-fine particles, this applying to the following). Further, as for the composition of the metal, either a single element or an alloy can be used. As the means for controlling the oxygen concentration, there are, for example, an exhausting system and a non-oxidizing gas introduction system. These may be disposed in combination, or a plurality of systems may be provided. It is preferable to select, for use as the exhausting system, one or some in combination, as necessary, from among an exhaust blower and various types of vacuum pumps (for example, a rotary pump, a mechanical booster pump, a liquid-sealed pump such as a water-sealed pump, an oil diffusion pump, a turbo-molecular pump, an ion getter pump, a cryopump, and so on). Also a vacuum gauge (vacuum meter) may be provided when necessary. The non-oxidizing gas can include rare gases, nitrogen, carbon monoxide, carbon dioxide, sulfur dioxide, sulfur hexafluoride, and so on. From among these gases, one may be selected in accordance with the property of metal. The non-oxidizing gases may be used in combination.

The adoption of the above configuration enables supply of metal to the use point in the hermetic zone with oxidation of the metal being suppressed in the supply apparatus of the present invention. Therefore, the generation amount of oxides such as oxide film, oxide and so on can be suppressed to a very low level, thereby improving the productivity.

Besides, metals having low free energy of formation and a high reactivity such as magnesium, calcium, titanium, and so on have a problem that they are susceptible to oxidation in processes of melting, holding, delivering, pouring, molding, and so on. The same goes in a metal in a state having excessive free energy on its surface such as powder. These metals are not only susceptible to oxidation but also at risk for ignition and explosion. According to the present invention, such metals can also be supplied in safety.

Besides, in the molding of metal, during supply of molten metal to a die-casting apparatus, the metal oxidizes and ignites to impair the strength, accuracy, and appearance of a product. This is prominent in metals susceptible to oxidation and hard to process, for example, a magnesium alloy and so on. One reason is that before a molten metal is supply to a cavity, oxide of the metal is contaminated thereinto. According to the present invention, the molten metal is supplied to the die-casting apparatus with oxidation of the metal being suppressed, resulting in improved quality of products. This effect is more enhanced by controlling the oxygen activity in a flowing space of the molten metal including the cavity, as described later.

By the way, at the time of melting the above-described metal, for example, a fireproof agent such as beryllium is sometimes added for fireproofing. Beryllium is well known as an element having a low abundance of element as well as a very high toxicity. It is known that beryllium adversely affects a human body, for example, a person has a respiratory disorder when he or she sucks its oxide. At present, beryllium diffuses in the environment during the producing step and through products containing it (pay attention to circumstances after the products turn into wastes). The use of such a harmful substance gives rise to a serious problem in viewpoints of safety of an operator and environment conservation. The present invention eliminates the necessity to use such a harmful fireproof gas, thus making it possible to ensure the safety of the operator and prevent a harmful substance from diffusing in the environment.

Next, description will be made on the container of the present invention. Here, the container is applicable to both a case in which it is used in a fixed state (for example, a melting furnace, a storing furnace, and so on of the molten metal) and a case in which it is used in a movable state (for example, a container and so on).

A container of the present invention comprises a frame forming an hermetic zone; a heat insulation disposed inside the frame; and at least one pipe disposed through the frame and the heat insulation.

Further, the present invention is a container capable of storing molten metal comprising means for applying a pressure to the furnace; and means for reducing the pressure in the furnace.

The frame forms a closed space being the hermetic zone therein. Further, the frame serves a function of holding the strength of the entire container and a function of protecting the heat insulation from the outside. The frame can be constituted of various kinds of metals, so that a suitable material may be selected in accordance with the use of the container. This selection is preferably made in consideration of physical property and chemical property of contents to be stored in the container. For example, the selection is made so that even if the heat insulation is broken, the frame never melts or breaks due to the heat of the contents or a chemical reaction with the contents. This also applies to the heat insulation, and various types of heat insulating bricks are selected in accordance with the use of the container.

The pipe provides an access between the outside of the frame and the inside space thereof. A plurality of the pipes may be provided. For example, an exhausting system is connected to this pipe to reduce the pressure in the space, thereby enabling control of the oxygen concentration and the oxygen activity in the hermetic zone of being the inside. Besides, for example, a non-oxidizing gas introduction system is connected to this pipe, thereby enabling supply of a non-oxidizing gas to the inside.

Furthermore, this pipe allows a fluid (molten metal or powder) to be taken out of/into the container by reducing and applying the pressure. For example, a case, in which the plurality of pipes are provided, is considered here. It is assumed that the contents are molten metal. In this case, when the non-oxidizing gas is introduced from the first pipe to apply a pressure to the hermetic zone, a force acts to push the molten metal to the outside through the second pipe. On the other hand, when the first pipe is connected to the exhausting system to reduce the pressure in the hermetic zone, the molten metal can be loaded from the outside through the second pipe. The pipe is heated by a heater or the like when necessary. The temperature is preferably set to be higher than the melting point of the contents flowing through the pipes. In this event, not only the movement of the molten metal or powder but also the oxygen concentration in the system can be controlled by the exhausting system and the non-oxidizing gas supply system. As described above, the invention of this application has one remarkable characteristic that the generation of pressure difference including the pressure reduced state contributes both to the mass transfer of the molten metal or powder and the prevention of oxidation. Besides, when the atmosphere in the pipe becomes oxidative, oxide attaches to the inside of the pipe to clog the pipe. In the present invention, it is possible not only to control the oxygen concentration in the pipe but also to prevent the contents from remaining in the pipe, thus solving such a clogging problem.

Further, the container of the present invention also includes a form comprising means for measuring the temperature in the hermetic zone and means for controlling the pressure in the frame in accordance with the measured temperature.

A heat insulation such as a heat insulating brick or the like is decreased in heat insulating performance with its aging. For example, when the molten metal is transported using a plurality of containers, the temperatures of the molten metal are sometimes different from others due to individual difference of the container. The temperature of the molten metal may sometimes drop to a level at which requirements of a user are not suitable. The container of the present invention employs a configuration in which the temperature of the hermetic zone or the molten metal is measured, and the pressure in the frame is controlled based on the measured temperature. Such a configuration is employed to control the heat conductivity in the system by the pressure. The pressure in the frame of, for example, a container, in which a temperature drop of the molten metal is recognized during carriage, is reduced by the exhausting system, so as to suppress the heat conductivity of the inside to low. Thereby, the temperature of the molten metal can be kept irrespective of decrease in the heat insulating performance of the heat insulation. It is also possible to decrease the difference in temperature between contents of a plurality of containers. Further, oxidation of the molten metal can also be prevented. The pressure control can be conducted through use of not temperature itself but of a rate of change (for example, a differential value) in temperature, which configuration enables more accurate temperature control of the molten metal.

The present invention is a container capable of delivering molten metal comprising a frame with a heat insulation on its inner face; a heater disposed on the inside of the heat insulation; means for measuring the temperature of the molten metal; and means for controlling the heater in accordance with the measured temperature.

The container of the present invention may have a configuration not only to control the pressure in the container in accordance with the measured temperature or the temperature change, but also a configuration to control the temperature of the heater disposed in the container in accordance with the measured temperature or the temperature change. In the configuration of the present invention, airtightness of the frame cannot be a severe subject. The heater may have a configuration in which, for example, a resistor wire is exposed inside the heat insulation. Other than that, it is also adoptable to use various type of heaters such as, for example, a sheathed heater, a radiant tube, and the like. The temperature in the container or the temperature or the change in temperature of the contents is measured to control the supply amount of energy (electric power, gas) to the heater in accordance with the measurement value. Thereby, the temperature of the molten metal can be kept irrespective of decrease in the heat insulating performance of the heat insulation. It is also possible to decrease the difference in temperature between contents of a plurality of containers. Further, such a configuration enables accurate management of the temperature of the contents in the container. Moreover, the container of the present invention can also be configured in combination with the above-described configurations of the respective containers of the present invention.

A molding apparatus of the present invention comprises means for molding metal supplied to a use point, an hermetic chamber disposed to surround the use point, and means for controlling the oxygen concentration in the hermetic chamber.

The molding apparatus of the present invention is applicable to various types of molding apparatuses, for example, for injection molding of molding the molten metal supplied to the use point by pushing out it into a space between a core mold (male mold) and a cavity mold (female mold), compression molding, extrusion molding, blow molding, and so on. In the molding apparatus of the present invention, the metal to be molded is supplied to the use point where the oxygen concentration is controlled (including reduction of the pressure). The metal can be supplied to the use point using the above-described supply apparatus and container of the present invention. For example, in the conventional metal molding, the metal oxidizes and ignites during supply of the metal to the apparatus to impair the strength, accuracy, and appearance of a product. This is prominent in a metal susceptible to oxidation and hard to process, for example, a magnesium alloy. According to the present invention, the metal is supplied to the molding apparatus with oxidation of the metal being suppressed, resulting in improved quality of the molded product. In the case of a die-casting apparatus, the above effect is more enhanced by controlling the oxygen activity in a flowing space of the molten metal including a nozzle, a sprue, a runner, and a gate. For the enhancement, it is only required to provide a valve and an exhausting system or a non-oxidizing gas supply system on the opposite side to the use point of the flowing space of the molten metal and control the pressure difference relative to the use point and the oxygen concentration.

A container according to another aspect of the present invention is characterized by comprising a sealed type container body capable of storing a molten metal, and the container has a through hole provided for controlling a pressure in the container; and a refractory lining formed inside of the container, and the refractory lining has a passage capable of flowing the molten metal, the passage is formed extended to an outside of the container, and the passage is formed towards an upper portion from an opening provided at a position on an inner and near a bottom portion of the container body.

In the present invention, the flow passage of the molten metal is configured to be buried in a refractory lining having a high heat conductivity formed inside of the container so that the heat of the container body easily conducts to the flow passage side. Therefore, when molten metal is stored in the container, the heat of the stored molten metal conducts through the refractory lining to make the flow passage almost equal in temperature to the stored molten metal. In a viewpoint of enhancing the heat retaining property of the container, the heat conductivity of the container is preferably as low as possible. In the present invention, the heat conductivity of a zone separating the container body from the flow passage is made high with an intention. This prevents the molten metal flowing through the flow passage from being cooled by the flow passage to solidify and attach to the surface of the flow passage. In other words, when the molten metal gradually solidifies and attaches to the flow passage, the flow passage (conventional pipe) becomes more likely to clog, but the present invention can effectively prevent clogging of the flow passage. Further, in the present invention, the flow passage becomes almost equal in temperature to the stored molten metal, which eliminates a decrease in viscosity of the molten metal flowing near the surface of the flow passage, making it possible to supply the molten metal from the container and load the molten metal into the container with a smaller pressure difference. In other words, the flow passage of the molten metal is constituted of the refractory lining having a high heat conductivity formed inside of the container, and the flow passage is made almost equal in temperature to the stored molten metal, so that the container of the present invention is very effective to a system of loading and supplying the molten metal into/from the container utilizing the pressure difference.

The container of the present invention is provided with a through hole used for controlling a pressure in the container, so that the molten metal can be loaded into the container though the flow passage by reducing the pressure in the container, for example, through the through hole. In the present invention, the molten metal is loaded into the container through the flow passage as described above, thereby allowing the metal attached to the surface of the flow passage to be cleaned by a hotter molten metal flowing through the flow passage. Therefore, in the present invention, the provision of the through hole used for controlling a pressure in the container makes it possible to effectively prevent the flow passage from clogging.

In the present invention, the flow passage for flowing the molten metal is configured to extend to the outside of the container and towards the upper portion from the position on the inner and near the bottom portion of the container body. In other words, in the present invention, as compared to the apparatus disclosed in Japanese Patent Laid-Open No. Hei 8-20826, members such as the stoke and the like which are exposed to the molten metal in the container become unnecessary, thus eliminating the necessity to replace the parts such as the stoke and the like. In addition, in the present invention, no member such as the stoke which obstructs preheating is disposed in the container to improve the productivity for preheating, thus enabling efficient preheating.

The container according to an embodiment of the present invention is characterized by further comprising a heat insulator inserted between an inner surface of the container body and the refractory lining (refractory member), and the heat insulator having a heat conductivity smaller than that of the refractory lining. As the refractory lining, a refractory castable material can be used which has a large strength with respect to, for example, molten aluminum. Besides, the heat insulation can include, for example, heat insulating castable refractories and non-castable heat insulating refractories (for example, board type heat insulator). In any case, the heat insulation is set lower in density, heat conductivity, and so on than the refractory member. Note that it is adoptable to use the refractory member and the heat insulation in a layered structure.

In other words, in the container of the present invention, the heat conductivity between the container and the flow passage is intentionally set to be higher than that between the inside and the outside of the container. This suppresses temperature drop of the flow passage. Especially when the flow passage portion projects outward like the container of the present invention, that region is likely to cool off. Hence, in the present invention, the heat conductivity is made low within the portion separating the flow passage from the inside of the body. This makes it possible to retain heat in the molten metal in the container and additionally decrease cooling of the flow passage affected by the outside, resulting in effective prevention of clogging of the flow passage. Moreover, if the flow passage can be kept at a high temperature, the molten metal becomes low in viscosity, thus making it possible to load and supply the molten metal into/from the container with a smaller pressure difference.

The container according to an embodiment of the present invention is characterized in that a bottom surface of the container body has an inclination towards the opening so that the opening is at a lower position of the body. Thereby, when the molten metal in the container runs short, the substantial area of the refractory member in contact with the molten metal in the container in the vicinity of the flow passage becomes larger than the area at a place apart from the flow passage. Therefore, it becomes possible to prevent as much as possible the flow passage from cooling to effectively prevent the flow passage from clogging, and load and supply the molten metal into/from the container with a smaller pressure difference. In addition, feeding of the molten metal remaining in the container by tilting the container can be efficiently performed with a reduced tilt angle and clogging of the flow passage being decreased as much as possible.

The container according to an embodiment of the present invention is characterized in that an upper portion of the container body is provided with a hatch capable of opening and closing.

In the present invention, the provision of such a hatch makes it possible that the hatch is opened and a heater such as a burner or the like is inserted to preheat the container, for example, prior to introduction of the molten metal into the container. Such preheating warms the flow passage through the refractory member, thereby making it possible to prevent more effectively the flow passage from clogging, and load and supply the molten metal into/from the container with a smaller pressure difference. Since the flow passage can be previously warmed as described above when the molten metal is loaded into the container through the flow passage, the present invention is effective particularly in that case.

The container according to an embodiment of the present invention is characterized in that the through hole is provided in the hatch.

The container is preheated by a gas burner prior to supply of the molten metal into the container as described above. This preheating is performed by opening the hatch and inserting the gas burner into the container. Therefore, the hatch is opened every supply of the molten metal into the container. In the present invention, such a hatch is provided with a through hole for internal pressure control, so that attachment of metal to the through hole for internal pressure control can be checked every supply of the molten metal into the container. When metal attaches, for example, to the through hole, the metal only needs to be removed every occurrence. Therefore, the present invention enables prevention of clogging of the pipe and hole used for internal pressure control.

An apparatus for supplying a molten metal in still another aspect of the present invention is characterized by comprising a furnace for melting the metal and storing the molten metal, and the furnace has a supply section for supplying the molten metal; a first pipe disposed on the supply section, and an end portion of the first pipe is immersed in the molten metal; and a holding mechanism for elastically holding the first pipe.

In the present invention, the end portion of the first pipe can be connected to the second pipe provided, for example, at a container to supply the molten metal from the furnace into the container through the first pipe and the second pipe. In this case, the molten metal can be supplied, for example, by generating a pressure difference between the container side and the furnace side. More specifically, for example, by reducing the pressure in the container by a vacuum pump, the molten metal can be supplied from the furnace into the container through the first pipe and the second pipe. Thus, the present invention can lessen the possibilities of the molten metal coming into contact with air to prevent oxidation of the molten metal. This eliminates the necessity of the work of removing oxide in which an operator strains the oxide out from the surface of the molten aluminum in the container through a sprue gate of the container, enabling improved productivity. Further, in the present invention, since the first pipe connected to the second pipe provided, for example, at the container is elastically held, thus greatly facilitating, for example, the work of aligning the end portion of the first pipe to a port of the second pipe provided at the container, enabling further improved productivity in combination with the above-described function.

Therefore, a system for supplying a molten metal in a main aspect of the present invention is characterized by comprising a furnace for melting the metal and storing the molten metal, and the furnace has a supply section for supplying the molten metal; a first pipe disposed on the supply section, and an end portion of the first pipe is immersed in the molten metal; a holding mechanism for elastically holding the first pipe; and a container having a second pipe capable of connecting to one end of the first pipe, and the container is supplied with the molten metal through the first pipe and the second pipe, and characterized by further comprising means for reducing a pressure inside the container.

An embodiment of the present invention is characterized in that the holding mechanism holds the first pipe so that the other end portion of the first pipe is freely positioned. This makes it possible to align more smoothly the other end portion of the first pipe to the second pipe provided, for example, at the container.

An embodiment of the present invention is characterized in that the holding mechanism comprises a pair of plate members facing with each other at a predetermined distance, and each of the plate members has an opening at a predetermined position respectively, so that the first pipe is inserted therethrough; and an elastic member inserted between the plate members. Further, the embodiment of the present invention is characterized in that a diameter of each of the openings of the plate members is sufficiently larger than an outer diameter of the first pipe, and the first pipe further comprises a holder provided on an outer periphery of the first pipe, and an outer diameter of the holder is larger than the outer diameter of the first pipe. This allows the holding mechanism to be realized with a simple configuration.

An embodiment of the present invention is characterized by further comprising a joint mechanism for fastening the first pipe with a second pipe to be connected to the first pipe. The provision of such a joint mechanism prevents displacement between the first pipe and the second pipe after the alignment.

There is a well-known technology in which molding is performed using molten metal like aluminum die-casting. For this molding, it is required to prepare a molten aluminum alloy. There are several ways for preparing the molten aluminum. In the first case, a melting furnace is provided for every die-casting machine. In another possible case, aluminum is molten in a centralized melting furnace, and die-casting machines include respective storing furnaces. In a large-scale factory, the latter may often be selected. Further, molten metal may be carried from a factory other than the die-casting factory.

The carriage of the molten metal from the centralized melting furnace to each storing furnace and the carriage of the molten metal from the other factory are generally performed using a container such as a container or the like. When the molten metal is supplied from the melting furnace to the container, aluminum in a solid state is first molten in the melting furnace, and then the molten aluminum is tapped through a hole bored in the melting furnace into a carrier container. On the other hand, supply of the molten metal from the container to the storing furnace of the die-casting machine, another melting furnace, or the like, is performed with a container being tilted like tea is poured from a teapot.

The inventors propose a technique of supplying molten metal using a pressure difference without tilting a container. This technique, through use of an airtight container including a pipe for loading and supplying the molten metal, reduces a pressure in the container to load the molten metal into the container and applies a pressure to the container to supply the molten metal. Portions in direct contact with the molten metal such as the inner face of the container and the inner face of the pipe are lined with a refractory member and a heat insulation.

As describe above, the molten metal is sometimes supplied from the melting furnace or the storing furnace to the carrier container, and sometimes supplied from the container to the use point (for example, the melting furnace of the die-casting machine). In either case, as time required for the supply becomes shorter, the productivity is further improved. On the other hand, as the flow rate of the molten metal becomes higher, the degree of wear of the lining on the inner face of the pipe increases and the life of the pipe shortens.

The inventors have used a pipe about 50 mm in inner diameter at the beginning. This is because of recognition that when the diameter is increased, pressure feeding of the molten metal requires a high pressure. When the diameter of a pipe (sectional area of the pipe) is increased, the weight of molten metal to be lifted increases, and in which viewpoint, a required pressure should increase. An increase in the required pressure is disadvantageous. This is because leakage of the pressure spends long time to delay a stop action and a system for applying a pressure becomes large. Especially when a tank for applying a pressure is used to supply a compressed gas, as the pressure required for the pressure feeding increases, the frequency of filling the compressed gas to the tank increases.

However, when the inventors tested a pipe about 70 mm in inner diameter in developing process of a system for supplying a molten metal using a pressure difference, it was found that aluminum can be supplied at a pressure lower than the case using the pipe about 50 mm in inner diameter. This indicates that the flow of aluminum in the pipe is affected by its viscosity greater than expected in the case of the pipe having a diameter of 50 mm. It shows that the effect of the viscosity coefficient and the like of aluminum is much greater in the pipe having a diameter of 50 mm than in the pipe having a diameter of 70 mm, restricting the flow rate at a considerably high rate.

The flow rate of the molten metal flowing through the pipe is higher at a position closer to the center, and is the smallest at a position in contact with the inner face of the pipe. On the other hand, a too large inner diameter of the pipe decreases the effect by the viscosity coefficient contributing to the entire flow but necessarily increases the pressure required to lift the molten metal. For example, in a pipe about 100 mm in inner diameter, the pressure required for pressure feeding is equal to or greater than that of the pipe about 50 mm in inner diameter. When the pressure is increased, the time required for recovering the pressure is also long as described above, giving rise to a problem in safety.

In consideration of the inventors, Reynolds number is the greatest at the center of the pipe and the smallest at a position in contact with the inner face of the pipe. In the case of a smaller pipe diameter, most part of the flow in the pipe is restricted by the surface of the pipe. As the pipe diameter increases, the proportion of the portion restricted by the pipe to the entire flow decreases. Within this region, as the pipe diameter is increased, the pressure required for pressure feeding decreases. When the pipe diameter is further increased, the entire flow becomes substantially steady. Consequently, it can be reasoned that the proportion of the portion restricted by the viscosity in the entire flow is small enough. Within this region, as the pipe diameter is increased, the pressure required for pressure feeding increases.

From the above fact, it is preferable, in the present invention, to set the inner diameter of a pipe (including a flow passage) for transporting molten aluminum by a pressure difference larger than 50 mm and smaller than 100 mm. The inventors conducted tests with the inner diameter of the pipe being changed to about 50 mm, about 60 mm, about 65 mm, about 70 mm, about 80 mm, about 90 mm, and about 100 mm. As a result, as the inner diameter was increased starting from about 50 mm, the pressure for pressure feeding decreased, but when the inner diameter exceeded about 90 mm, a high pressure was required conversely. It was found that aluminum can be pressure fed at the lowest pressure in the case ranging from about 65 mm to about 80 mm in particular. On the other hand, it was also found that as the inner diameter becomes larger, the time required for pressure feeding a predetermined amount (about 600 Kg) of molten aluminum becomes shorter.

Conventionally, this type of pipe has been about 50 mm in inner diameter. This is because it has been considered that in the case of a pipe having a diameter larger than that, a high pressure is required when applying a pressure to a container to supply molten metal through the pipe. In contrast to this, the present inventors found that the inner diameter of a flow passage and a pipe linking thereto is preferably about 65 mm to about 85 mm, greatly exceeding the abovementioned 50 mm, more preferably, about 65 mm to about 80 mm, and furthermore preferably, about 70 mm. In other words, it can be reasoned that when the molten metal flows upward through the flow passage and the pipe, two parameters such as the weight of the molten metal itself existing in the flow passage and the pipe and the viscosity resistance of the inner wall of the flow passage and the pipe greatly affect a resistance which obstructs the flow of the molten metal. When the inner diameter is smaller than 65 mm here, the molten metal flowing through the flow passage is affected by both the weight of the molten metal itself and the viscosity resistance of the inner wall at any position. When the inner diameter is 65 mm or larger, however, a zone hardly affected by the viscosity resistance of the inner wall gradually increases from near the center of the flow. This region has a very great effect, so that the resistance obstructing the flow of the molten metal starts decreasing. It is only required to apply a pressure to the container at a very low pressure when supplying the molten metal from the container. In short, conventionally only the weight of the molten metal itself has been regarded as a variable factor of the resistance obstructing the flow of the molten metal without taking the effect by such a region into consideration at all, and thus the inner diameter has been set about 50 mm because of productivity, maintainability, and so on. On the other hand, when the inner diameter exceeds about 90 mm, the weight of the molten metal itself becomes very dominant as the resistance obstructing the flow of the molten metal, resulting in increased resistance obstructing the flow of the molten metal. From the result of a prototype container made by the present inventors, it is only required to apply a pressure to the container at a very low pressure for the case of an inner diameter from about 65 mm to about 80 mm, and an inner diameter of about 70 mm is the most preferable in viewpoint of standardization and productivity. In other words, since the pipe diameter is standardized in a discrete manner, for producing, for example, a pipe having an inner diameter of about 80 mm, it is required to use a structure and pipe one size greater than that for producing a pipe having an inner diameter of about 70 mm. A smaller pipe diameter can be more preferable because of easy handling and good productivity.

BEST MODE FOR CARRYING OUT THE INVENTION

Hereinafter, embodiments of the present invention will be described with reference to the drawings.

Figure 1:
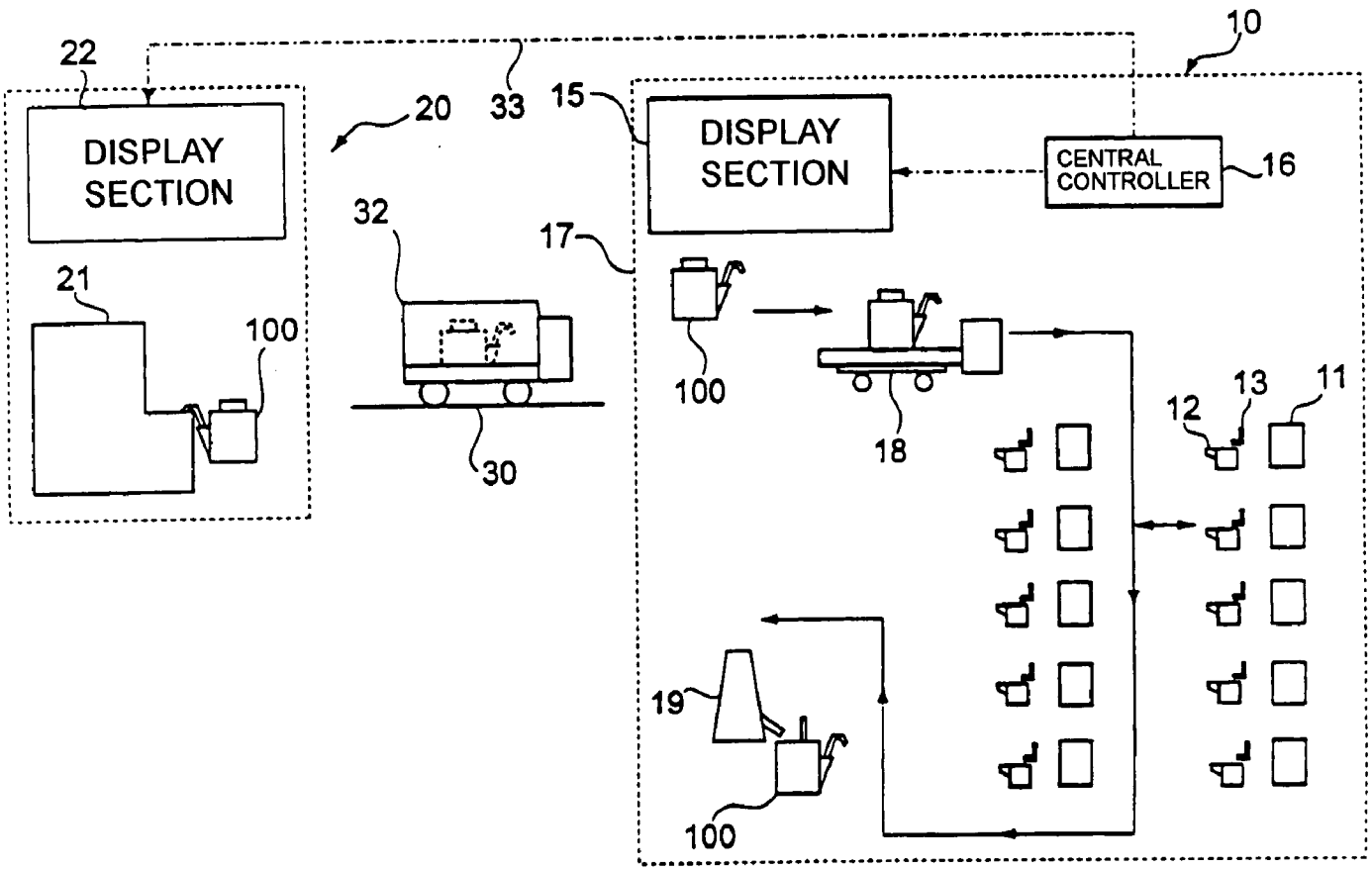
FIG. 1 is a schematic diagram showing the configuration of a metal supply system according to an embodiment of the present invention.

FIG. 1 is a diagram showing the entire configuration of a metal supply system according to an embodiment of the present invention.

As shown in the drawing, a first factory 10 and a second factory 20 are provided at locations apart from each other across, for example, a public road 30.

In the first factory 10, a plurality of die-casting machines 11 are arranged as use points. Each of the die-casting machines 11 molds products in a desired shape by injection molding using molten aluminum as a raw material. The products can include, for example, parts relating to an engine of an automobile and the like. Besides, the molten metal is not limited only to an aluminum alloy, but alloys containing other metals such as magnesium, titanium, and so on as main constituents are also usable. Near the die-casting machines 11, there are storing furnaces (local storing furnaces) 12 that temporarily store molten aluminum before shots. This local storing furnace 12 is designed to store the molten aluminum for a plurality of shots, so that the molten aluminum is injected from the storing furnace 12 into the die-casting machine 11 through a tandish (container) 13 or a pipe for every shot. Further, each of the storing furnaces 12 is provided with a level sensor (not shown) that detects the level of the molten aluminum stored in a container and a temperature sensor (not shown) that detects the temperature of the molten aluminum. Detection results by these sensors are passed to a control panel of each of the die-casting machines 11 or a central controller 16 in the first factory 10.

At a receiving station of the first factory 10, a receiving table 17 is disposed for receiving a later-described container 100. The container 100 received at the receiving table 17 in the receiving station is delivered by a delivery vehicle 18 to a predetermined die-casting machine 11, so that the molten aluminum is supplied from the container 100 to the storing furnace 12. The container 100 after completion of the supply is returned to the receiving table 17 in the receiving station again by the delivery vehicle 18.

In the first factory 10, a first furnace 19 is provided for melting aluminum and supplying it to the container 100, and the container 100 supplied with the molten aluminum from the first furnace 19 is also delivered by the delivery vehicle 18 to a predetermined die-casting machine 11.

In the first factory 10, a display section 15 is disposed which states a fact that the die-casting machines 11 demand for the additional aluminum melt. More specifically, for example, an ID number is given to every die-casting machine 11 and displayed on the display section 15, so that the number on the display section 15 corresponding to the die-casting machine 11 which demands for the additional molten aluminum is lighted up. Based on the display on the display section 15, an operator carries the container 100 to the die-casting machine 11 corresponding the number using the delivery vehicle 18 to supply the molten aluminum. The display on the display section 15 is performed by a control of the central controller 16 based on the detection result by the level sensor of the aluminum melt.

In the second factory 20, a second furnace 21 is provided for melting aluminum and supplying it to the container 100. A plurality of types of containers 100 are provided which are different, for example, in capacity, pipe length, height, width, and so on. For example, there are a plurality of types of containers 100 different in capacity in accordance with the capacities or the like of the local storing furnaces 12 for the die-casting machines 11 in the first factory 10. However, it is, of course, adoptable to unify the containers 100 into one standard.

The containers 100 supplied with the molten aluminum from the second furnace 21 are mounted on a truck 32 for carriage by means of a fork lift truck (not shown). The truck 32 carries the containers 100 through the public road 30 to near the receiving table 17 in the receiving station in the first factory 10, so that the containers 100 are received at the receiving table 17 by means of a fork lift truck (not shown). Besides, vacant containers 100 placed in the receiving station are returned to the second factory 20 by the truck 32.

In the second factory 20, a display section 22 is disposed which states a fact that the die-casting machines 11 in the first factory 10 call additional molten aluminum. The display section 22 is almost the same in configuration as the display section 15 in the first factory 10. The display on the display section 22 is performed by a control of the central controller 16 in the first factory 10, for example, via a communication line 33. It should be noted that, out of the die-casting machines 11 which demand for supply of the molten aluminum, the die-casting machines 11, which are determined to be supplied with the molten aluminum from the first furnace 19 in the first factory 10, are displayed in distinction from the other die-casting machines 11 on the display section 22 in the second factory 20. For example, it is designed to blink the numbers corresponding to the die-casting machines 11 determined as above. This can prevent the molten aluminum from being supplied by mistake from the second factory 20 side to the die-casting machines 11 which have been determined to be supplied with the molten aluminum from the first furnace 19. Further, on this display section 22, data transmitted from the central controller 16 is also displayed in addition to the above display.

Next, description will be made on the action of the metal supply system configured as described above.

The central controller 16 monitors the amount of the molten aluminum in each of the storing furnaces 12 through the level sensor provided at each of the local storing furnaces 12. When there arises a demand for supplying the molten aluminum to one storing furnace 12, the central controller 16 transmits to the second factory 20 side through the communication line 33 the "ID number" of the storing furnace 12, "temperature data" of the storing furnace 12 detected by the temperature sensor provided at the storing furnace 12, "form data" on the form (described later) of the storing furnace 12, final "time data" of the storing furnace 12 running out of the molten aluminum, "traffic data" of the public road 30, "amount data" of the molten aluminum required for the storing furnace 12, "temperature data", and so on. In the second factory 20, these data are displayed on the display section 22. Based on these displayed data, the operator determines on his or her experiences the point of time for dispatch of the container 100 from the second factory 20 and the temperature of the molten aluminum at the time of the dispatch so that the container 100 is delivered immediately to the storing furnace 12 before the storing furnace 12 runs out of the molten aluminum and the molten aluminum at that time is at a desired temperature. Alternatively, it is also adoptable to capture these date into a personal computer (not shown), estimate, through use of predetermined software, the point of time for dispatch of the container 100 from the second factory 20 and the temperature of the molten aluminum at the time of the dispatch so that the container 100 is delivered immediately to the storing furnace 12 before the storing furnace 12 runs out of the molten aluminum and the molten aluminum at that time is at a desired temperature, and display the time and temperature. Alternatively, it is also adoptable to automatically control the temperature of the second furnace 21 based on the estimated temperature. It is also adoptable to determine the amount of the molten aluminum to be stored in the container 100 based on the aforementioned "amount data."

When the truck 32 with the container 100 mounted thereon departs, passes the public road 30, and arrives at the first factory 10, the container 100 is received from the truck 32 at the receiving table 17 in the receiving station.

Then, the received container 100 is delivered together with the receiving table 17 to a predetermined die-casting machine 11 by the delivery vehicle 18 so that the molten aluminum is supplied from the container 100 to the storing furnace 12.

Figure 2:
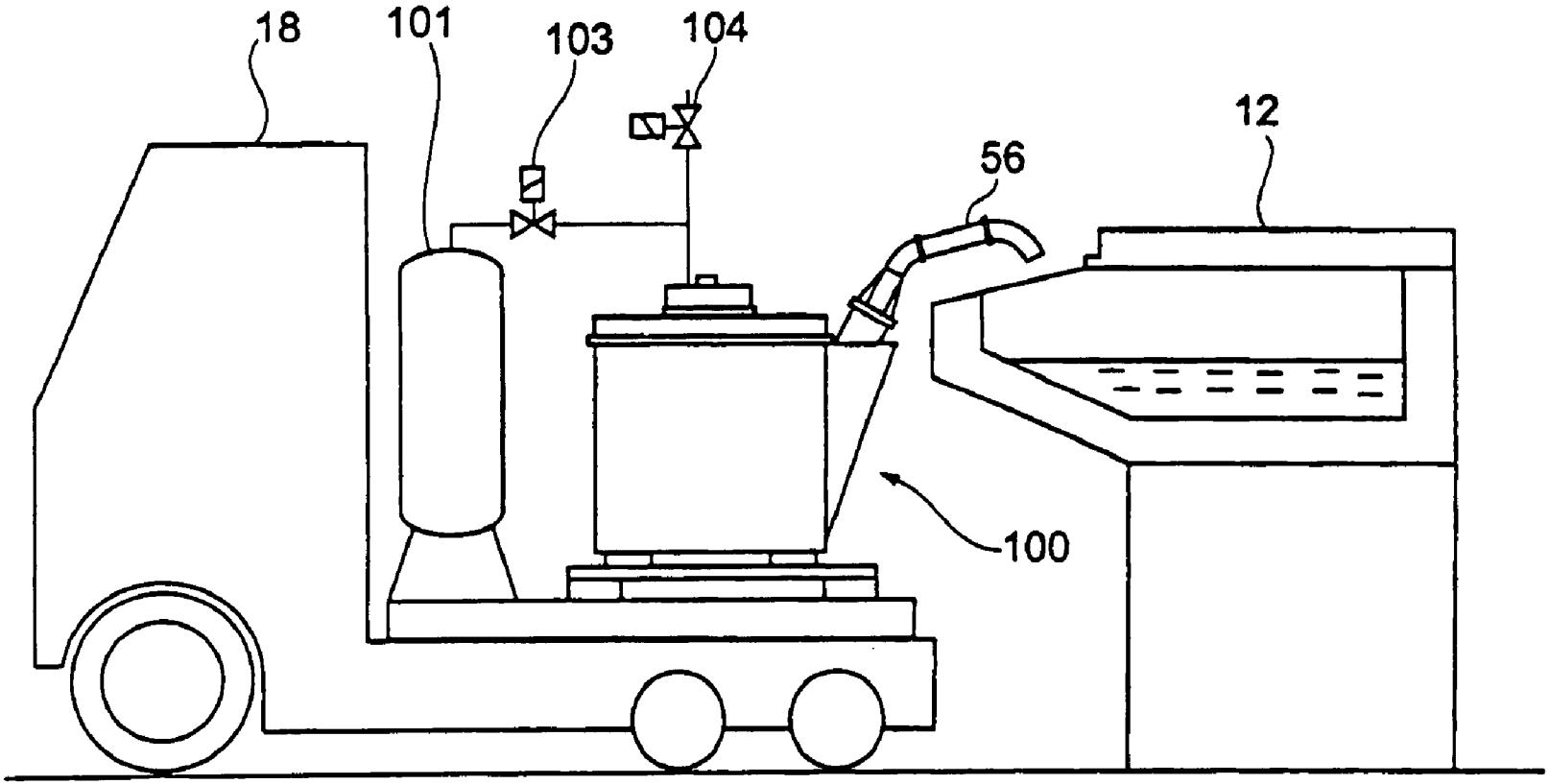
FIG. 2 is a diagram showing the relation between a container and a storing furnace according to the embodiment of the present invention.

As shown in FIG. 2, this example is configured such that compressed air is sent out from a reservoir tank 101 into the hermetic type container 100 to cause the molten aluminum stored in the container 100 to be discharged through a pipe 56 and supplied to the storing furnace 12. Note that numeral 103 denotes a pressure valve, and numeral 104 denotes a leak valve in FIG. 2.

By the way, the storing furnaces 12 have various heights, and the tip of the pipe 56 is controllable to be placed at an optimal position above the storing furnace 12 by means of a lifting mechanism provided on the delivery vehicle 18. The lifting mechanism, however, cannot cope by itself with the storing furnace 12 depending on its height in some cases. Hence, in this system, data regarding the height of the storing furnace 12, the distance to the storing furnace 12, and so on are previously sent to the second factory 20 side as the "form data" regarding the form of the storing furnace 12, and on the second factory 20 side, for example, the container 100 having an optimal form, for example, an optimal height is selected and delivered based on the data. Note that the container 100 having an optimal size may be selected and delivered in accordance with the amount to be supplied.

Figure 3:
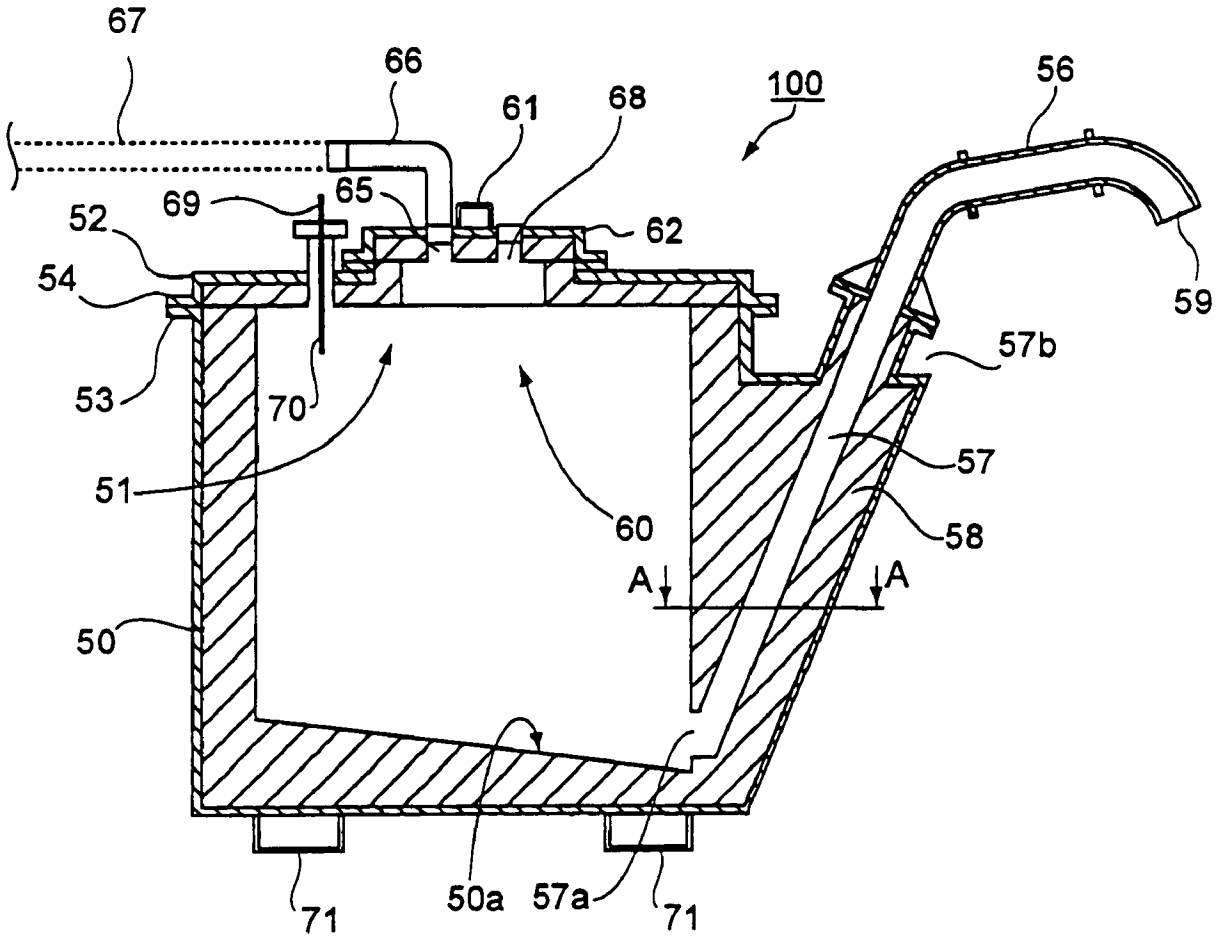
FIG. 3 is a cross-sectional view of the container according to the embodiment of the present invention.
Figure 4:
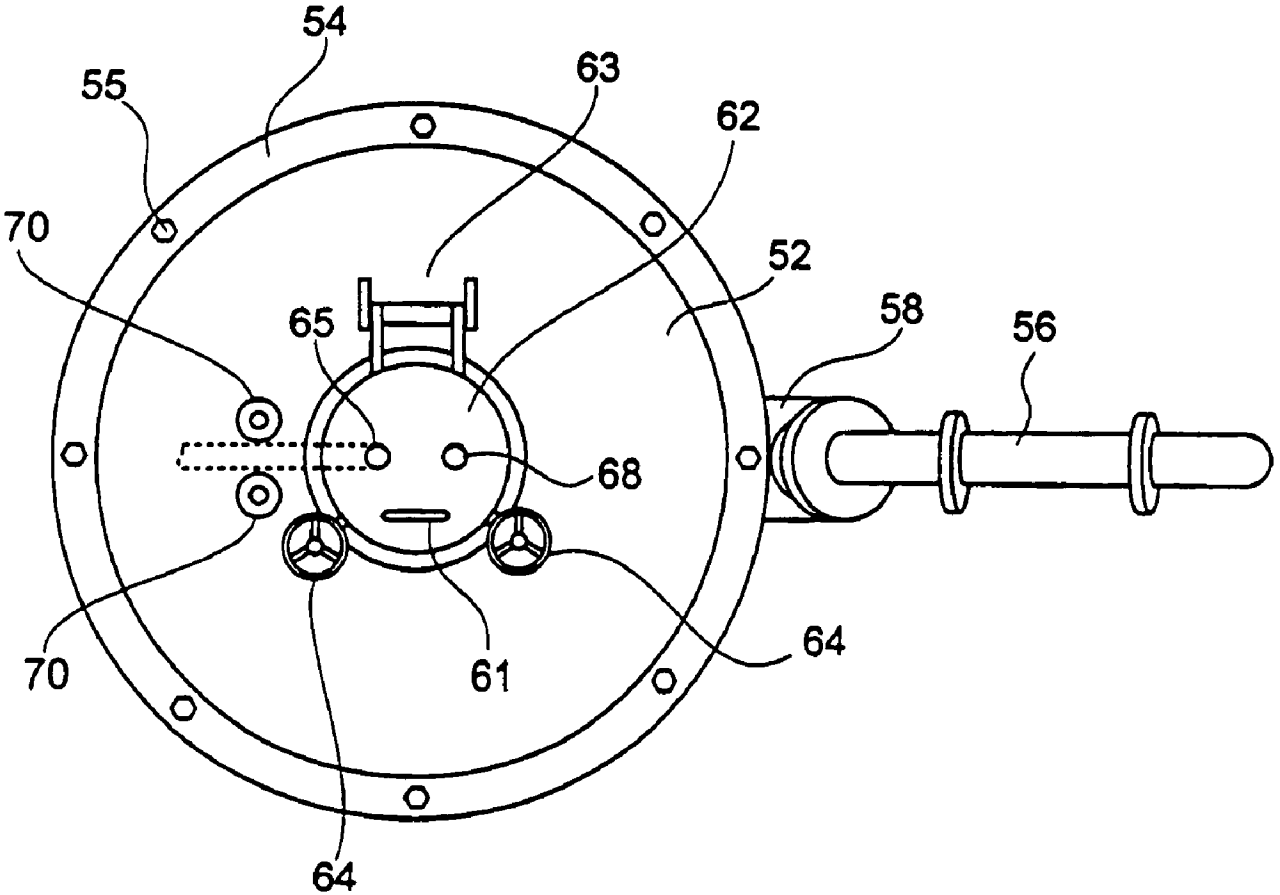
FIG. 4 is a plane view of FIG. 3.

Next, the container 100 (container capable of supplying the molten metal by pressure) suitable for the system configured as described above will be described with reference to FIG. 3 and FIG. 4. FIG. 3 is a cross-sectional view of the container 100, and FIG. 4 is a plane view thereof.

The container 100 is configured such that a large lid 52 is provided at an upper opening 51 of a bottomed cylindrical body 50. Flanges 53 and 54 are provided at outer peripheries of the body 50 and the large lid 51 respectively, so that the flanges are fastened together with bolts 55 to fix the large lid 51 to the body 50. It should be noted that the outside of the body 50 and the large lid 51 is made of, for example, metal and the inside thereof is made of refractories, with a heat insulator being inserted between the metal frame and the refractories.

At one point on the outer periphery of the body 50, a pipe attachment portion 58 is provided which is provided with a flow passage 57 starting from the inside of the body 50 and communicating with the pipe 56.

Figure 5:
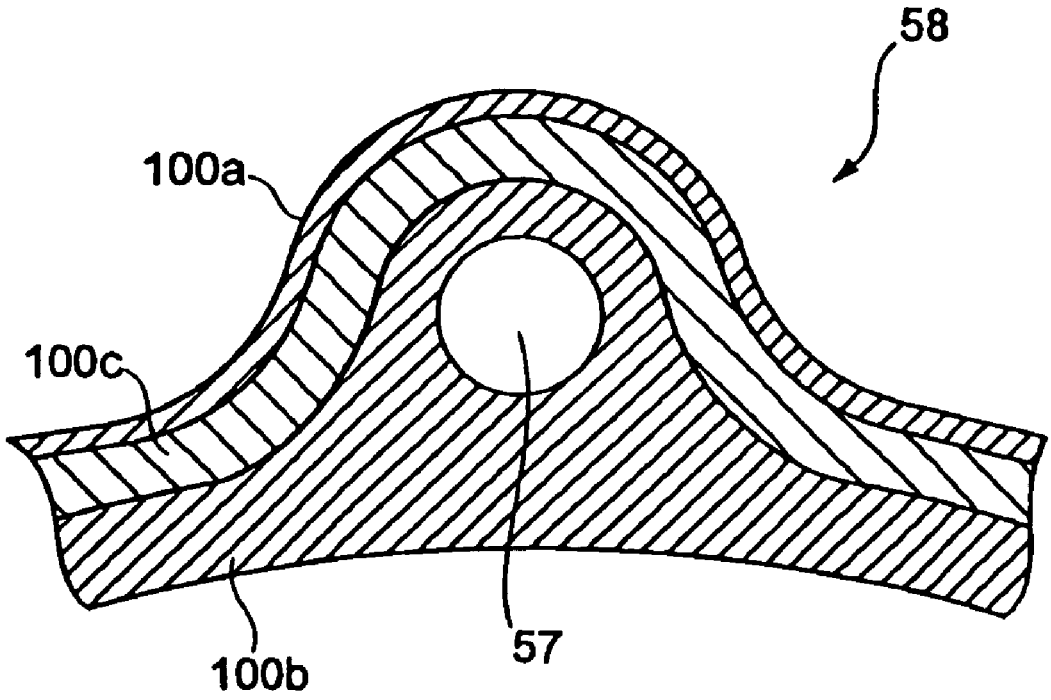
FIG. 5 is a cross-sectional view of a part in FIG. 3.

Here, FIG. 5 is a cross-sectional view taken along a line A-A across the pipe attachment portion 58 shown in FIG. 3.

As shown in FIG. 5, the outside of the container 100 is constituted of a metal frame 100*a*, and the inside thereof is constituted of a refractory member 100*b*, with a heat insulation 100*c* in a plurality of layers being inserted between the frame 100*a* and the refractory member 100*b*. The heat insulation 100*c* is formed here by lining, from the inner side, heat insulating castable refractries and a board type heat insulator. Besides, the flow passage 57 is formed to be sheathed in the refractory member 100*b* which is provided on the inside of the container 100. Further, to positively conduct heat in the container to the flow passage side, a region separating the inside of the container from the flow passage is composed of the refractory member 100*b* having a large heat conductivity. On the other hand, the heat insulating property on the outside of the flow passage (opposite to the container body side) needs to be enhanced, and thus a heat insulation is disposed on the outside of the refractory member.

The flow passage 57 in the pipe attachment portion 58 extends toward an upper portion 57*b* on the outer periphery of the body 50, through an opening 57*a* provided at a position on the inner periphery of the body 50 close to a bottom portion 50*a* of the container body. The pipe 56 is fixed to communicate with the flow passage 57 in the pipe attachment portion 58. The pipe 56 has the form of the letter Γ, so that an end portion 59 of the pipe 56 faces downward. More specifically, the end portion 59 of the pipe 56 is inclined, for example, at about 10° with respect to the vertical line. Giving such an inclination reduces, for example, splash of the molten metal from the molten metal surface to the container side when the molten metal supplied from the end portion 59 flows down to the local storing furnace side.

Feeding of the molten metal by the pressure may be performed with the end portion 59 of the pipe 56 sunk in the molten metal stored on the storing furnace side. This decreasess the possibilities of the molten metal coming into contact with air and involving air during supply, thereby enabling improved quality of the molten metal.

Figure 6:
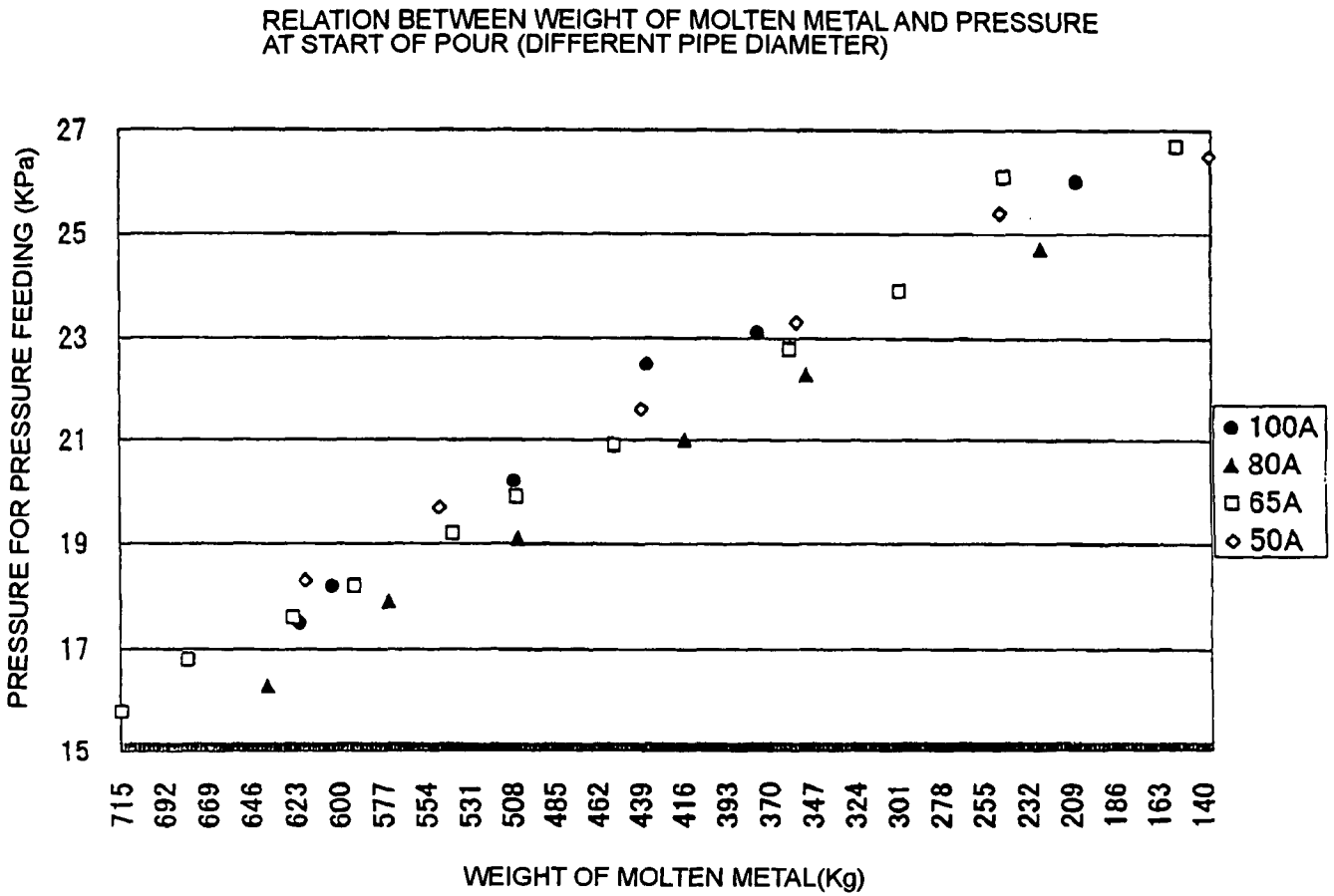
FIG. 6 is a graph showing the relation between a pipe diameter and a pressure of pressure feeding.

The flow passage 57 and the pipe 56 linking thereto are preferably almost the same in inner diameter, about 65 mm to about 85 mm. Conventionally, this kind of pipe has been about 50 mm in inner diameter. Here, FIG. 6 is a graph showing the relation between a pipe diameter and a pressure for pressure feeding. This graph shows the dependence upon the pipe diameter of the minimum pressure required for pressure feeding when the weight of the molten metal in the container is changed. As is clear from the drawing, it is found that a pressure required when the inner diameter of the pipe is about 50 mm and about 100 mm is higher than that when the inner diameter of the pipe is within a range from about 65 mm and about 80 mm.

The pipe here is made by forming a ceramic layer on the inner surface of SUS metal. The temperature of the molten aluminum was almost 700° C.

At almost the center of the aforementioned large lid 52, an opening 60 is provided, and a hatch 62 with a handle 61 attached thereto is disposed at the opening 60. The hatch 62 is provided with packing for sealing the inside of the container airtight, on a face on the large lid 52 side. Packing made of silicon is circularly provided here. The hatch 62 is provided at a position slightly higher than the upper face of the large lid 52. A portion on the outer periphery of the hatch 62 is attached to the large lid 52 through a hinge 63. This allows the hatch 62 to freely open and close the opening 60 in the large lid 52. In addition, bolts with handles 64 for fixing the hatch 62 to the large lid 52 are attached to two points of the outer periphery of the hatch 62 in a manner opposite to the position to which the hinge 63 is attached. By closing the opening 60 in the large lid 52 with the hatch 62 and rotating the bolts with handles 64, the hatch 62 is fixed to the large lid 52. On the other hand, by inversely rotating the bolts with handles 64 to release the fixation, the hatch 62 can be opened from the opening 60 in the large lid 52. Then, with the hatch 62 opened, maintenance of the inside of the container 100 and insertion of a gas burner at the time of preheating can be performed through the opening 60.

Further, a through hole 65 for internal pressure control for reducing and applying the pressure in the container 100 is provided at the center or a position slightly off from the center of the hatch 62. To the through hole 65, a pipe 66 for applying and reducing the pressure is connected. The pipe 66 extends upward from the through hole 65, bends at a predetermined height, and extends in the horizontal direction. The surface of a portion of the pipe 66 inserted into the through hole 65 is threaded, and on the other hand, the through hole 65 is also threaded. This firmly screws the pipe 66 to the through hole 65.

To one end of the pipe 66, a pipe 67 for applying the pressure or reducing the pressure can be connected. A tank storing a compressed gas and a pump for applying the pressure are connected to the pipe for applying the pressure, and a pump for reducing the pressure is connected to the pipe for reducing the pressure. Then, it is possible to load the molten aluminum into the container 100 through the pipe 56 and the flow passage 57 using a pressure difference resulting from reducing the pressure, and it is possible to pour the molten aluminum to the outside of the container 100 through the flow passage 57 and the pipe 56 using a pressure difference resulting from applying the pressure. It should be noted that use of an inert gas, for example, nitrogen gas as the compressed gas makes it possible to prevent more effectively oxidation of the molten aluminum during the application of the pressure.

In the present invention, a connecting port of the pipe 67 for applying or reducing the pressure is disposed not at the large lid but at the hatch so that an operator can check a clogging of the pipe 67 and the connecting port. For example, clogging of the pipe 67 and the connecting port can be checked when necessary such as after carriage of the container to a customer, before supply of molten metal by pressure feeding, and so on. Therefore, the molten metal can be supplied reliably.

In this embodiment, while the through hole 65 for applying and reducing the pressure is provided in the hatch 62 which is disposed at almost the center portion of the large lid 52, the aforementioned pipe 66 extends in the horizontal direction, thus making it possible to perform safely and easily the work of connecting the pipe 67 for applying or reducing the pressure to the pipe 66. Furthermore, the pipe 66 extends in the horizontal direction as described above and thus can be rotated with respect to the through hole 65 by a small force, so that the pipe 66 screwed to the through hole 65 can be fixed and removed by a very small force, for example, without using a tool.

At a position slightly off from the center of the hatch 62 and opposite to the abovementioned through hole 65 for applying and reducing the pressure, a through hole 68 for releasing pressure is provided, and a relief valve (not shown) can be attached to the through hole 68 for releasing pressure. Thereby, for example, when the inside of the container 100 reaches a predetermined pressure or higher, the inside of the container 100 is released to the atmospheric pressure in viewpoint of safety.

In the large lid 52, two through holes 70 for level sensors are disposed with a predetermined distance therebetween into which two electrodes 69 are inserted respectively as the level sensors. The electrodes 69 are inserted into the through holes 70 respectively. The electrodes 69 are disposed opposite to each other in the container 100, and their tips extend, for example, to positions at a level almost the same as that of a maximum level of the molten metal in the container 100. It is thus possible to detect the maximum level of the molten metal in the container 100 by monitoring the conduction state between the electrodes 69, thereby enabling prevention of excessive supply of the molten metal to the container 100 with more reliability.

On the rear face of the bottom portion of the body 50, two channels 71 having a cross section in a square shape into which, for example, a fork of the fork lift truck (not shown) is inserted and a predetermined length, are disposed, for example, in parallel to each other. Further, the entire bottom portion inside the body 50 is inclined to be low on the flow passage 57 side. This reduces so-called remained melt when the molten aluminum is supplied to the outside through the flow passage 57 and the pipe 56 by compression. In addition, when the container 100 is tilted, for example, at the time of maintenance to pour the molten aluminum to the outside through the flow passage 57 and the pipe 56, the angle of tilting the container 100 can be decreased, providing improved safety and productivity.

As described above, in the container 100 according to this embodiment, the through hole 65 for internal pressure controll is provided in the hatch 62, and the pipe 66 for internal pressure control is connected to the through hole 65, so that attachment of metal to the through hole 65 for internal pressure controll can be checked every supply of the molten metal into the container 100. This makes it possible to prevent clogging of the pipe 66 and the through hole 65 used for controlling a pressure in the container.

Further, in the container 100 according to this embodiment, the through hole 65 for internal pressure controll is provided in the hatch 62, and additionally the hatch 62 is provided at almost the center of the upper face portion of the container 100 corresponding to a position of the molten aluminum where the level of the melt changes and melt drops splash off at a relatively rare, resulting in less attachment of the molten aluminum to the pipe 66 and the through hole 65 used for controlling a pressure in the container. This makes it possible to prevent clogging of the pipe 66 and the through hole 65 used for controlling a pressure in the container.

Further, in the container 100 according to this embodiment, the hatch 62 is provided in the upper face portion of the large lid 52, so that the distance between the inner face of the hatch 62 and the liquid surface is longer by the thickness of the large lid 52 than the distance between the inner face of the large lid 52 and the liquid surface. This reduces the possibility of aluminum attaching to the inner face of the hatch 62 provided with the through hole 65, making it possible to prevent clogging of the pipe 66 and the through hole 65 used for controlling the internal pressure.

Next, a supply system from the second furnace 21 to the container 100 in the second factory 20 will be described with reference to FIG. 6.

Figure 7:
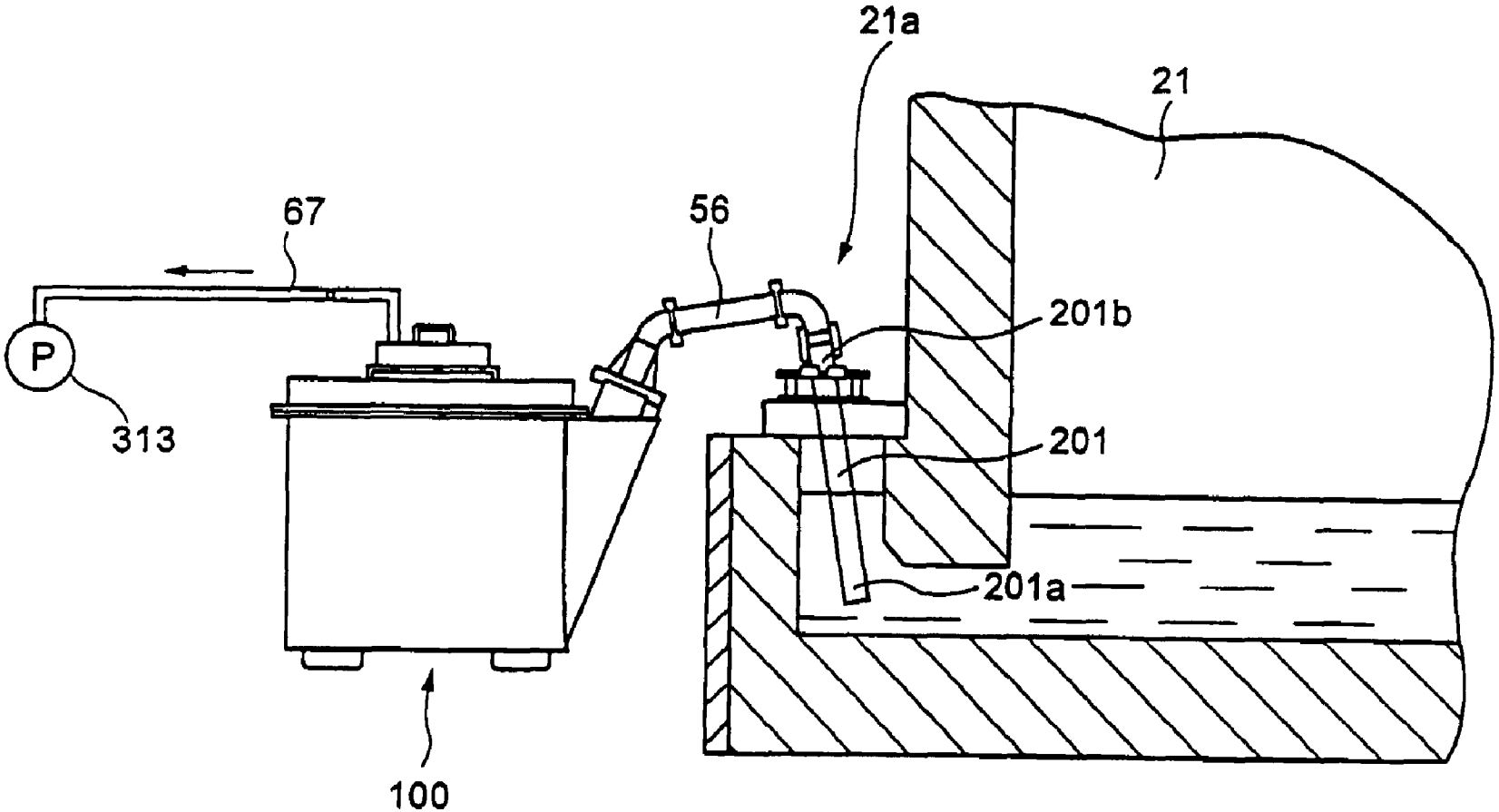
FIG. 7 is a view showing the configuration of a supply system from a second furnace to a container in a second factory according to the embodiment of the present invention.
Figure 8:
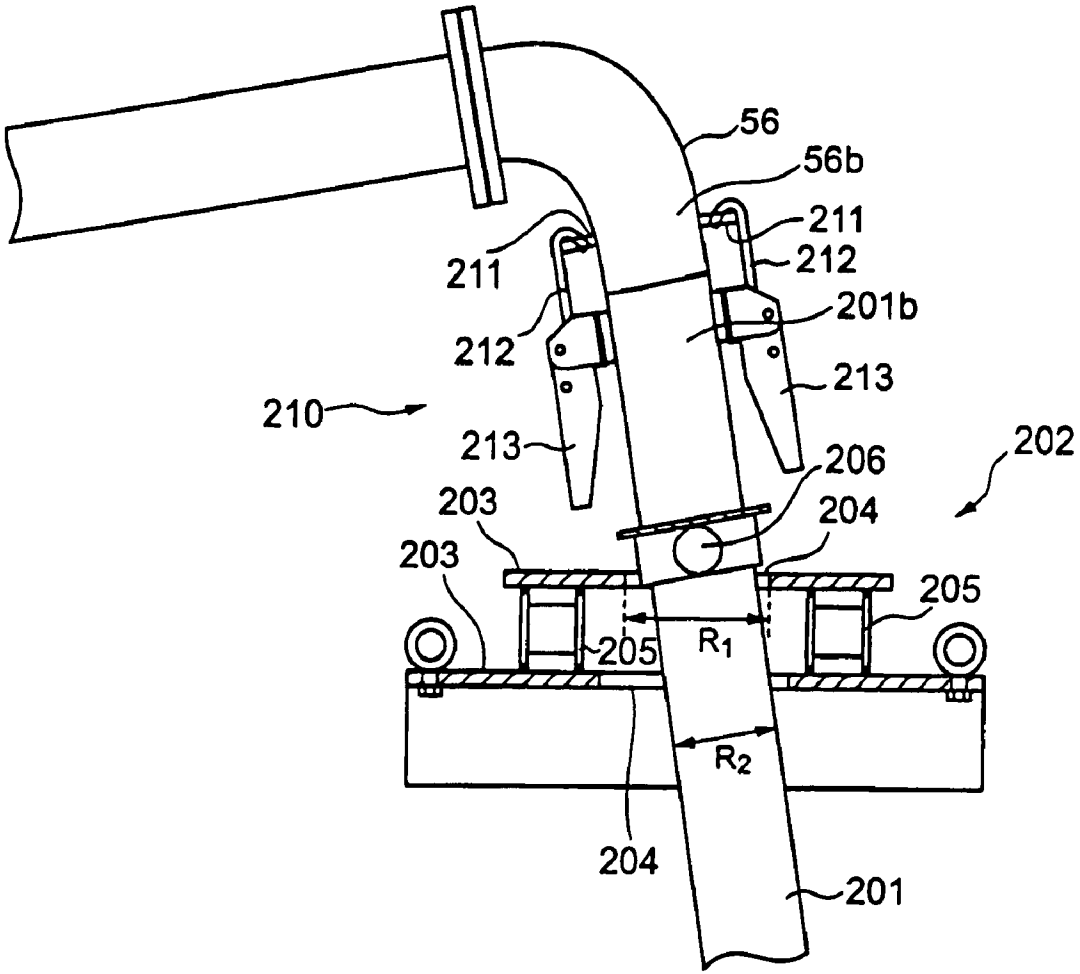
FIG. 8 is an enlarged side view of a holding mechanism and a connecting portion between a tip portion of a suction pipe and a tip portion of a pipe in the container according to the embodiment of the present invention.
Figure 9:
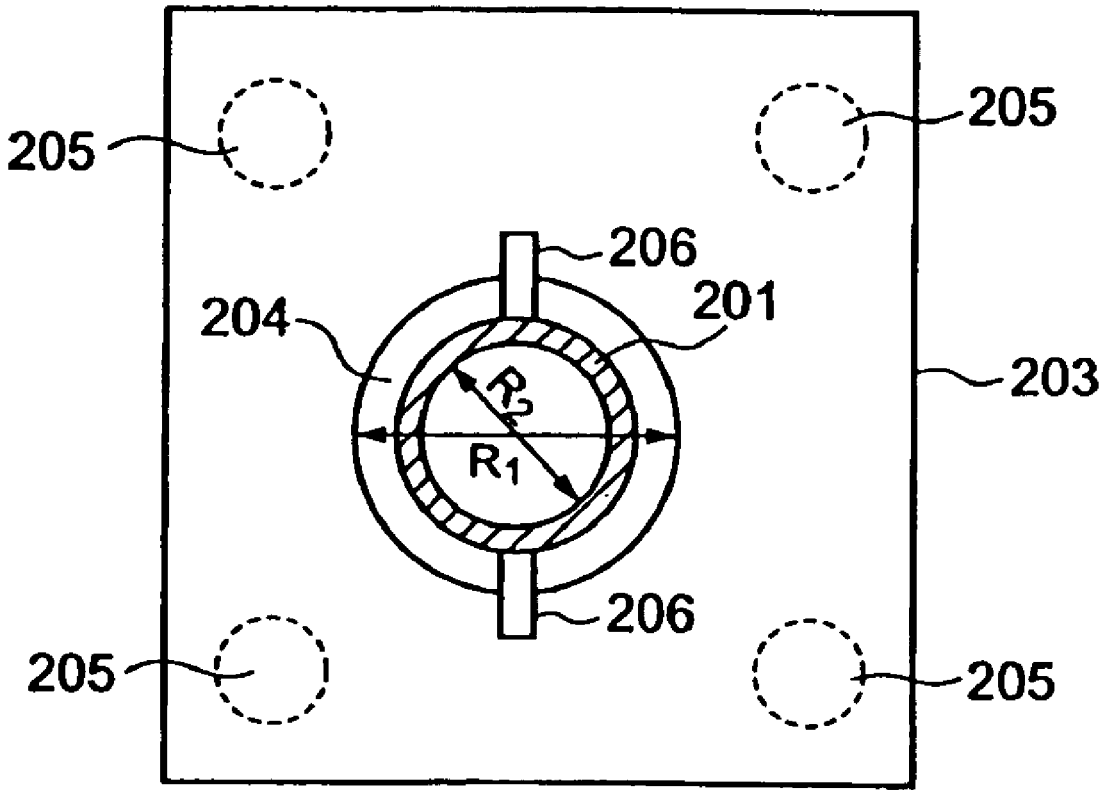
FIG. 9 is a plane view of the holding mechanism shown in FIG. 8.

As shown in FIG. 7, the second furnace 21 stores the molten aluminum. The second furnace 21 is provided with a supply section 21*a* into which a suction pipe 201 is inserted. The suction pipe 201 is disposed such that an end portion (another tip portion 201*b* of the suction pipe 201) is immersed in the liquid surface of the molten aluminum in the supply section 21*a*. More specifically, one tip portion 201*a* of the suction pipe 201 extends close to the bottom portion of the second furnace 21, and the other tip portion 201*b* of the suction pipe 201 is drawn outward from the supply section 21*a*. The suction pipe 201 is held basically with an inclination by means of a holding mechanism 202. The inclination angle is, for example, about 10° with respect to the vertical line so that the inclination matches that of the tip portion of the pipe 56 of the above-described container 100. The tip portion 201*b* of the suction pipe 201 is to be connected to the tip portion of the pipe 56 of the container 100, and the matching of the inclinations thus facilitates connection between the tip portion 201*b* of the suction pipe 201 and the tip portion of the pipe 56 of the container 100.

Then, the pipe 67 connected to a pump 313 for redusing the pressure is connected to the pipe 66. Subsequently, the pump 313 is running for redusing the pressure in the container 100. This allows the molten aluminum stored in the second furnace 21 to be loaded into the container 100 through the suction pipe 201 and the pipe 56.

In this embodiment, in particular, the molten aluminum stored in the second furnace 21 is loaded into the container 100 through the suction pipe 201 and the pipe 56, so that the molten aluminum never comes into contact with outside air. Therefore, no oxide is generated, and as a result, the molten aluminum supplied using this system is very excellent in quality. In addition, the work of removing oxide from the container 100 also becomes unnecessary, resulting in improved productivity.

In this embodiment, in particular, introduction of the molten aluminum into the container 100 and feeding of the molten aluminum from the container 100 can be performed using substantially only two pipes 56 and 312, thus enabling the system configuration to be very simple. Further, shapely decreased possibilities of the molten aluminum of coming into contact with the outside air can almost eliminate generation of oxide.

FIG. 7 shows a producing flow of the above-described system when applied to an automobile factory.

First, as shown in FIG. 6, the molten aluminum stored in the second furnace 21 is loaded (molten metal is received) into the container 100 through the suction pipe 201 and the pipe 56 (Step 501).

Then, as shown in FIG. 1, the container 100 is carried by the truck 32 through the public road 30 from the second factory 20 to the first factory 10 (Step 502).

Then, in the first factory (use point) 10, the container 100 is delivered by the delivery vehicle 18 to the die-casting machine 11 for producing an automobile engine, and the molten aluminum is supplied from the container 100 to the storing furnace 12 (Step 503).

Then, the die-casting machine 11 molds the automobile engine using the molten aluminum stored in the storing furnace 12 (Step 504).

At last, an automobile is assembled using the automobile engine thus molded and other parts, resulting in a complete automobile (Step 505).

In this embodiment, the automobile engine is made of aluminum containing little or no oxide as described above, thus making it possible to produce an automobile having an engine excellent in performance and durability.

Next, another embodiment of the present invention will be described.

Figure 12:
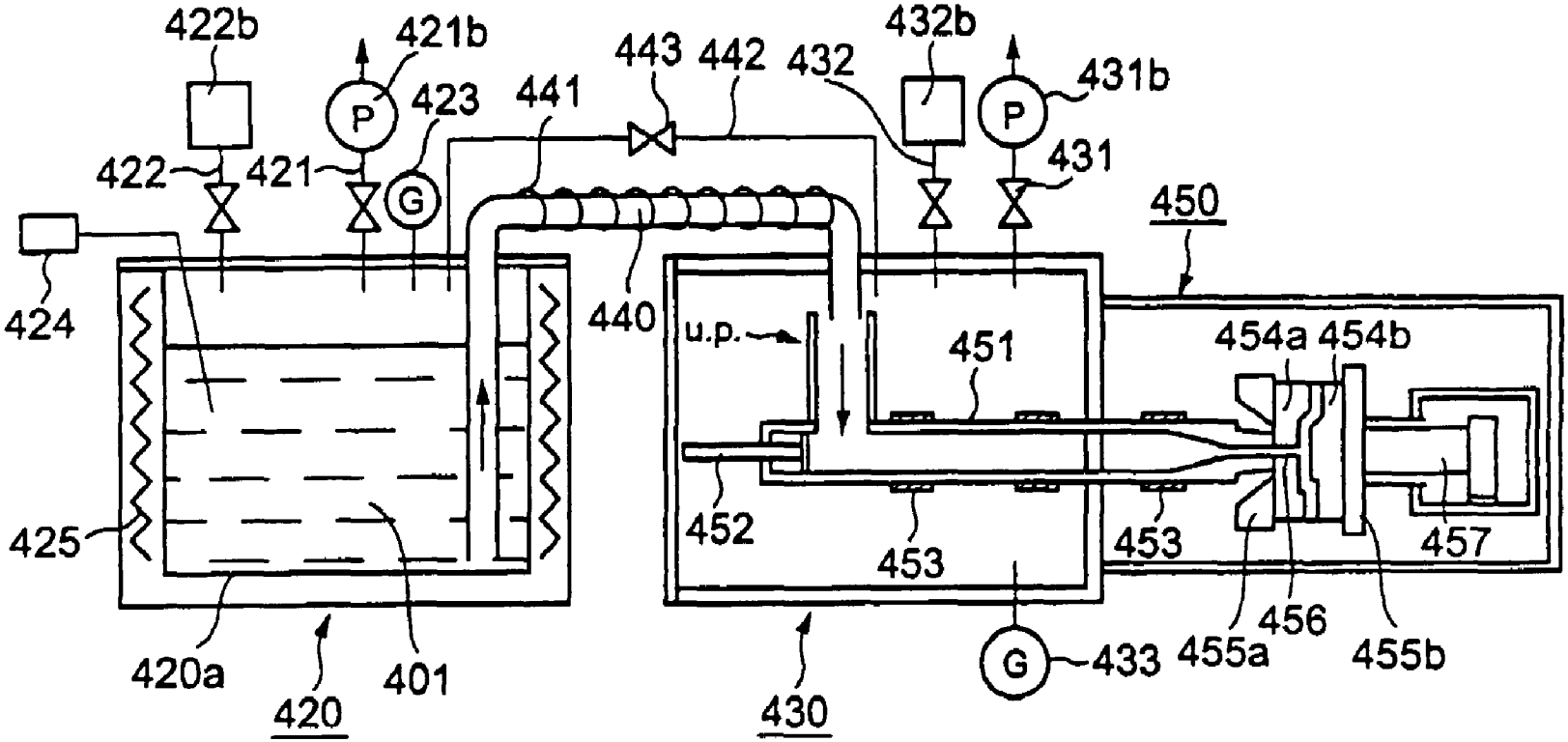
FIG. 12 is a view schematically showing an example of a supply apparatus of the present invention.

FIG. 12 is a view schematically showing an example of the configuration of a supply apparatus and a molding apparatus of the present invention. The following description will be made on an example in which the present invention is applied to molding of a magnesium alloy.

A storing furnace 420 is a furnace for storing metal in a melt (molten metal). As the material of a chamber 420*a* of the storing furnace 420, 18-8 stainless steel is used in this example, and further the inside thereof has been subjected to anodizing process with an FC plate. The storing furnace 420 stores a molten magnesium alloy 401 therein. A heater 425 keeps the melting temperature in this storing furnace. Further, the storing furnace 420 is connected with an vacuum system 421 that reduces the pressure the inside and a non-oxidizing gas introduction system 422 that supplies a non-oxidizing gas. Numeral 422*b* denotes a reservoir of gas. In this example, the vacuum system 421 includes at least one vacuum pump 421*b*. Further, the non-oxidizing gas introduction system 422 also serves a function of applying a pressure to the inside of the storing furnace 420. Furthermore, the storing furnace 420 includes a pressure gauge (G) 423 that measures the pressure therein and a temperature sensor 424 that measures the temperature of the molten metal. As the pressure gauge 423, a Bourdon gauge, a Pirani gauge, a BA gauge, and the like are selectively used in accordance with the pressure range in use. As the temperature sensor 424, a thermocouple, an emission pyrometer, and the like can be used.

In a purge chamber 430, the molten metal is passed. The purge chamber 430 is structured such that the inside can be kept airtight. Similarly to the storing furnace 420, the purge chamber 430 is connected with a vacuum system 431 that reduces the pressure the inside and a non-oxidizing gas introduction system 432 that supplies a non-oxidizing gas. In this example, the vacuum system 431 includes at least one vacuum pump 431*b*. Further, the non-oxidizing gas introduction system 432 also serves a function of applying a pressure to the inside of the purge chamber 430. Numeral 432*b* denotes a reservoir of gas. Furthermore, the purge chamber 430 is also provided with a pressure gauge (G) 433 that measures the pressure therein.

The storing furnace 420 and the purge chamber 430 are connected to each other through a pipe 440 and a bypass pipe 442. Numeral 443 denotes a bypass valve. A heater 441 such as a resistor or the like is wound around the pipe 440. The heater 441 keeps the temperature inside the pipe at a temperature at which the magnesium alloy melts. Now, when the pressure in the purge chamber 430 is made lower than the pressure in the storing furnace 420, the molten magnesium alloy 401 is pushed out from the storing furnace 420 through the pipe 440 to the purge chamber 430. On the other hand, when the pressure in the purge chamber 430 is made higher than the pressure in the storing furnace 420, the molten magnesium alloy 401 remaining in the pipe is loaded from the purge chamber 430 side to the storing furnace 420. In either case, the oxygen concentration in the system is controlled to suppress oxidation of metal. Thus, metal is safely supplied, without combustion or explosion, to a use point in the purge chamber 430. In addition, since oxidation of metal is suppressed, generation of oxide is also suppressed or no oxidation occurs. This makes it possible to supply high quality metal with a clean surface and no oxide. Furthermore, in the present invention, since the oxygen concentration in the system is controlled to suppress oxidation of metal, there is no need to add a fireproof agent such as hazardous beryllium. This also improves the work environment. Moreover, a harmful substance is never contained in products, remnants (such as burrs), and wastes (wastes and failures of products). This can prevent harmful substances from spreading into the environment.

By the way, the purge chamber 430 is also a supply point (use point) of the molten metal for a die-casting apparatus 450. In this example, a loading chamber 451 of the die-casting apparatus 450 is provided to project into the purge chamber 430. The loading chamber 451 and the purge chamber 430 are sealed airtight by welding or the like. The loading chamber 451 has an opening through which molten metal (a magnesium alloy 1 in this case) is supplied. The supplied metal is supplied to a mold side by means of an injection cylinder 452. Incidentally, the loading chamber 451 is kept warm by heaters 453. A mold 454*a* is a cavity mold and a mold 454*b* is a core mold, and the metal supplied into a space therebetween is molded into a predetermined shape. The molds 454*a* and 454*b* are intervened between clamping mechanisms 455*a* (on the fixed side) and 455*b* (on the moving side). A hydraulic cylinder 457 can apply a pressure to the clamping mechanism 455*b* on the moving side.

According to the molding apparatus of the present invention, the supplied metal is never oxidized at the use point. Therefore, no oxide is contaminated into products, resulting in high quality products. Further, the accuracy is also improved, and its effect is prominent particularly in thin products. Moreover, products are improved in appearance without darkening.

Generally, oxide is generated as high as at 20% to 40% in the molding of the magnesium alloy, causing a very low productivity. According to the present invention, the generation of oxide can be suppressed to a very low level. Therefore, according to the present invention, the productivity can be improved to reduce the production cost.

Moreover, wastes discharged in the producing step and wastes generated after use of products contain hazardous beryllium and so on. The magnesium alloy is also designated as a dangerous substance. According to the present invention, the amount of wastes can be reduced and a hazardous substance is also unnecessary, thus enabling reduced cost of treating the wastes. Moreover, use of the container of the present invention permits the magnesium alloy as a dangerous substance to be carried in safety.

Figure 13:
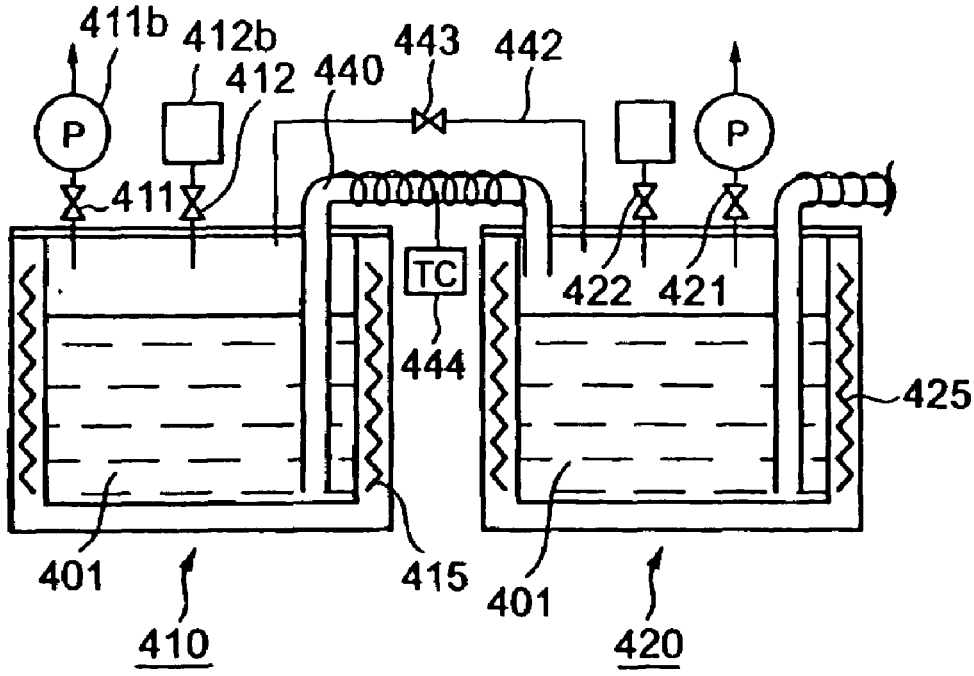
FIG. 13 is a view schematically showing another example of the supply apparatus of the present invention.
Figure 14:
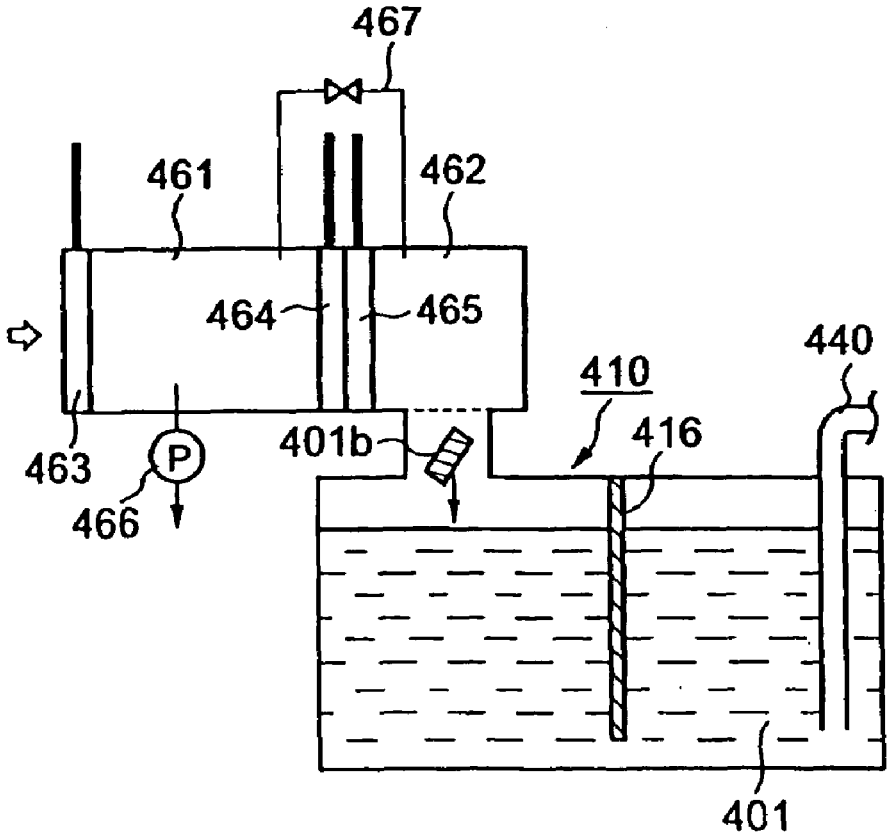
FIG. 14 is a view schematically showing an example of a melting furnace of the present invention.

FIG. 13 is a view schematically showing another example of the supply apparatus of the present invention. Description will be made here on the configuration in which a melting furnace 410 is provided at a prior stage of the storing furnace 420 shown in FIG. 10.

Figure 10A:
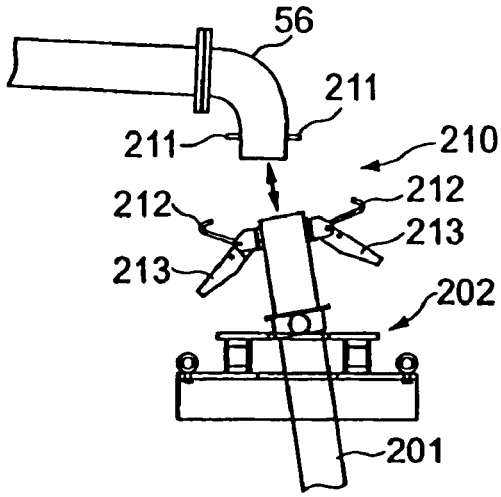
FIGS. 10A to 10C are views for explaining actions of connecting the pipe of the container and the suction pipe of a supply furnace according to the embodiment of the present invention.
Figure 10B:
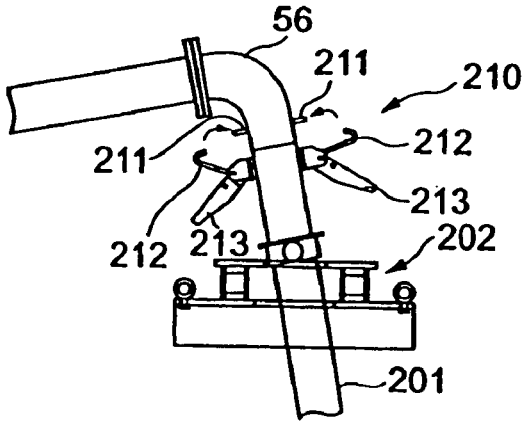
Figure 10C:
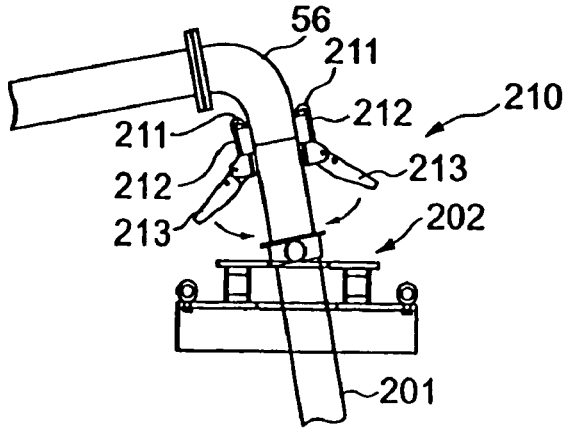

FIG. 10 is a view schematically showing an example of the melting furnace of the present invention. The melting furnace 410 is a furnace for melting metal in a solid state. The configuration of the melting furnace 410 is very similar to that of the storing furnace 420. As the material of a chamber 410*a* of the melting furnace 410, 18-8 stainless steel is used in this example, and further the inside thereof has been subjected to anodizing process with an FC plate. A molten magnesium alloy 401 is thrown into the melting furnace 410 and heated by a heater 415. Numeral 416 denotes a partition wall. Further, the melting furnace 410 is connected with a vacuum system 411 that reduces the pressure the inside and a non-oxidizing gas introduction system 412 that supplies a non-oxidizing gas. Numeral 412*b* denotes a reservoir of gas. In this example, the vacuum system 411 includes at least one vacuum pump 411*b*. Further, the non-oxidizing gas introduction system 412 also serves a function of applying a pressure to the inside of the melting furnace 410. Furthermore, the melting furnace 410 includes a pressure gauge (G) 413 that measures the pressure therein and a temperature sensor 414 that measures the temperature of molten metal.

For throwing a solid metal 401*b* into the melting furnace 410, an airtight door 463 is first opened, and the solid metal 401*b* is loaded into a purge chamber 461 from the outside. The airtight door 463 is closed, and the inside of the purge chamber 461 is exhausted by an exhausting system 466. With a bypass 467 being opened to balance the pressures in the purge chamber 461 and a throw-in chamber 462, the airtight door 464 and a heat insulating door 465 are opened. The solid metal is moved by a pusher or a drawer. A bottom portion of the throw-in chamber 462 has a rotation mechanism whose rotation throws the solid metal into the melting furnace 410.

Figure 15:
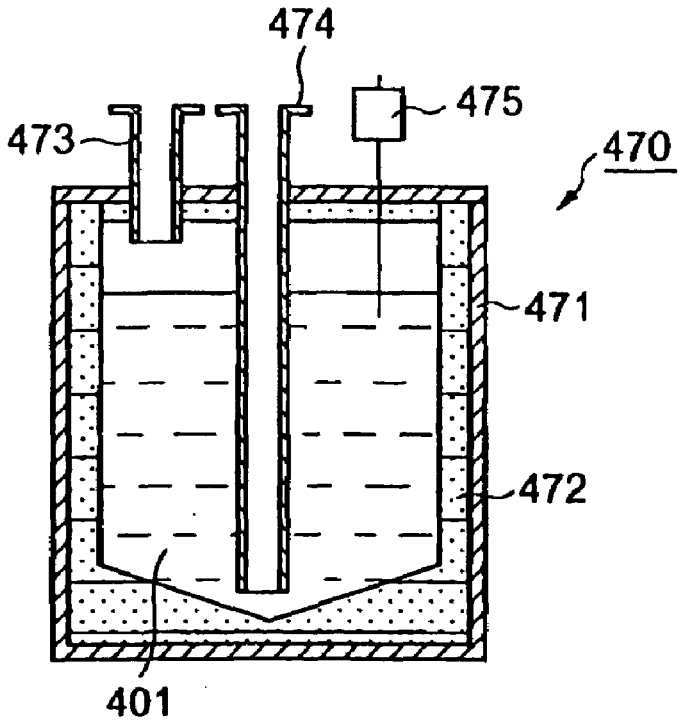
FIG. 15 is a view schematically showing an example of the configuration of the container of the present invention.

FIG. 15 is a view schematically showing an example of the configuration of a container of the present invention. This container (container) 470 comprises a frame 471 forming an hermetic zone being literally hermetic, a heat insulation 472 disposed on the inside of the frame 471, and pipes 473 and 474 disposed through the frame 471 and the heat insulation 472. Further, a temperature sensor 475 is also provided for measuring the temperature in the hermetic zone The frame 471 forms a closed space that is the hermetic zone therein. Further, the frame 471 serves a function of holding the strength of the entire container 470 and a function of protecting the heat insulation 472 from the outside. The frame 471 can be constituted of various kinds of metals, and thus a suitable material may be selected in accordance with use of the container. This selection is preferably conducted in consideration of physical property and chemical property of contents to be stored in the container. For example, the selection is conducted so that even if the heat insulation is broken, the frame never melts or breaks due to the heat of the contents or a chemical reaction with the contents. This also applies to the heat insulation, and thus various types of heat insulating bricks are selected in accordance with use of the container.

The pipes 473 and 474 provide an access between the outside of the container 470 and the inside space thereof. One or a plurality of such pipes may be provided. For example, a not-shown exhausting system is connected to this pipe 473 to reduce the pressure inside the container, thereby enabling control of the oxygen concentration and the oxygen activity in the hermetic zone of the inside. Besides, for example, a non-oxidizing gas introduction system is connected to this pipe 473, thereby enabling supply of a non-oxidizing gas to the inside.

The above-describe application and reduction of a pressure allows a fluid (molten metal or powder) to be taken into/out of the container. When the non-oxidizing gas is introduced through the pipe 473 to apply a pressure to the hermetic zone, the molten metal can be pushed to the outside through the pipe 474. On the other hand, when the pipe 473 is connected to the exhausting system to reduce the pressure in the hermetic zone, the molten metal can be loaded from the outside through the pipe 474. The pipe 474 is heated by a heater or the like when necessary. The temperature is preferably set to be higher than the melting point of the contents flowing through the pipe. In this event, not only the movement of the molten metal or powder but also the oxygen concentration in the system can be controlled by the exhausting system and the non-oxidizing gas supply system. As described above, the present invention has one remarkable characteristic that the generation of pressure difference including the pressure reduced state contributes both to the mass transfer of the molten metal or powder and the prevention of oxidation. Besides, when the atmosphere in the pipe 474 becomes oxidative, oxide attaches to the inside of the pipe to clog the pipe. In the present invention, it is possible not only to control the oxygen concentration in the pipe 474 but also to prevent the contents from remaining in the pipe, thus solving such a clogging problem.

Figure 16:
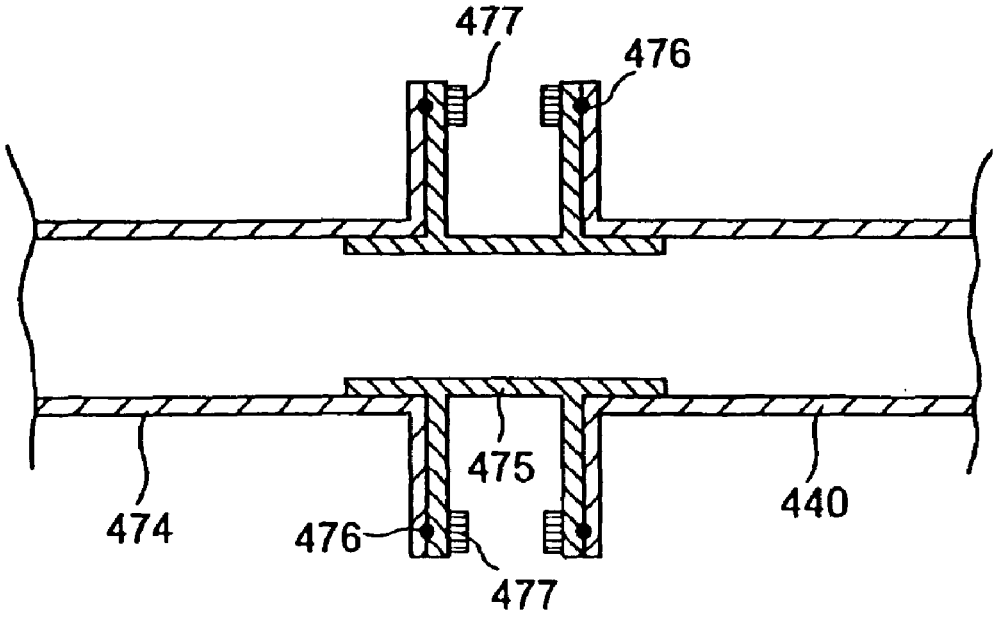
FIG. 16 is a view showing an example of a joint usable for connecting pipes.

FIG. 16 is a view showing an example of a joint usable for connecting pipes. The container of the present invention can serve a function substantially equivalent to that of the storing furnace 420 in the above-described embodiment. In other words, it is possible to use one or a plurality of containers 470 in place of the storing furnace 420. In this case, a pipe 474 only needs to be connected to a pipe 440 on the side to which metal is supplied (for example, the purge chamber 430).

The pipe 474 and the pipe 440 can be connected to each other using, for example, a joint 475. The joint 475 includes gaskets 476 and is thus airtightly connected with the pipe 474 and the pipe 440. When the gaskets 476 are made of a resin, it is preferable to cool the neighborhood of the gaskets by water-cooled heads 477. The water-cooled heads 477 can be omitted when using gaskets made of copper, gold or the like. In addition, this joint 475 can also be used to connect the pipe 473 to the exhausting system and the gas introduction system.

Figure 17:
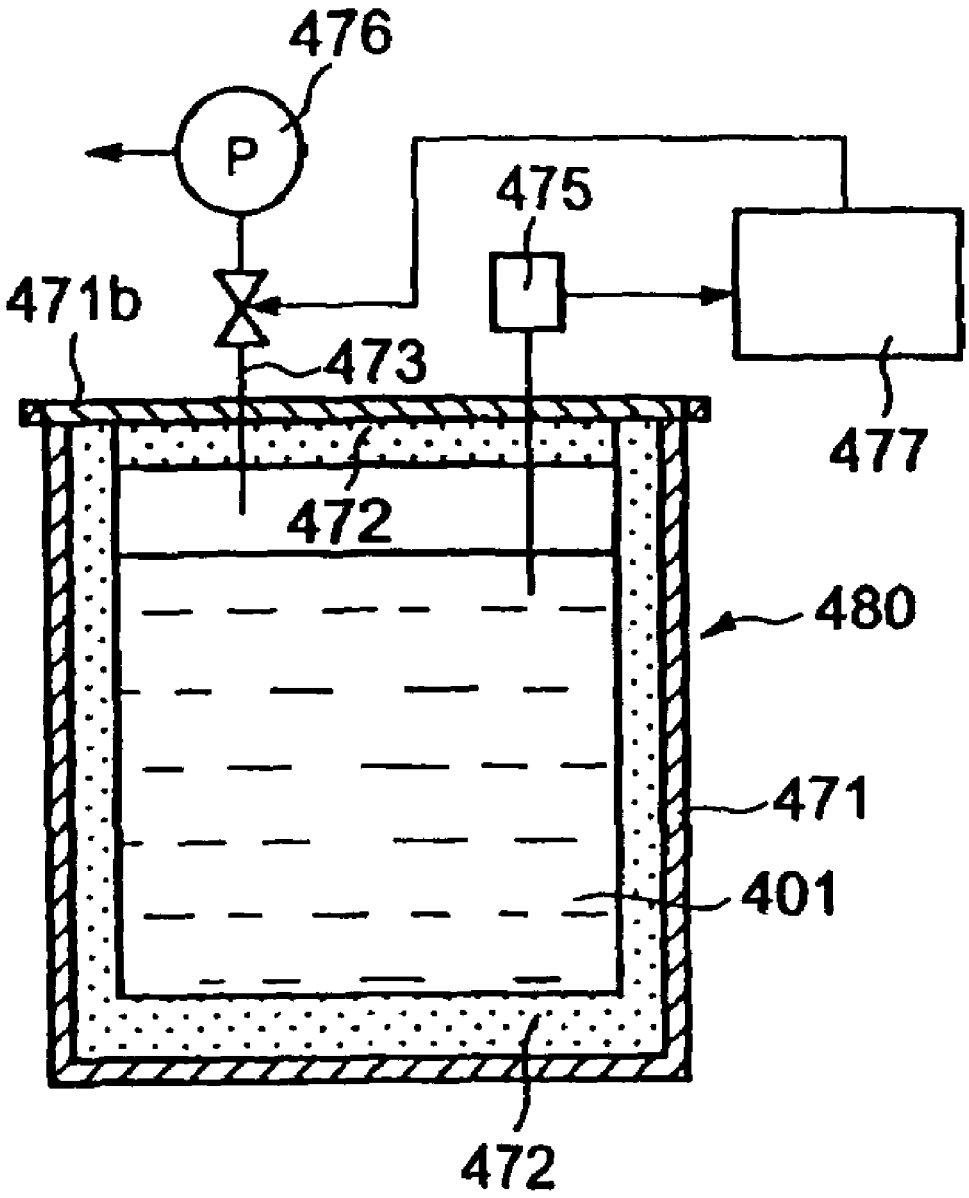
FIG. 17 is a view schematically showing another example of the configuration of the container of the present invention.

FIG. 17 is a view schematically showing another example of the configuration of the container according to the present invention. In this container 480, a frame 471 has an opening that is sealed airtight with a lid 471*b*. Further, this container 480 is connected to an exhausting system 476 through a pipe 473.

In addition, there provided is a controller 477 that measures the temperature of a molten metal 401 using a temperature sensor 475 and controls the exhausting system 476 in accordance with the measured temperature or the rate of change in temperature. For example, opening and closing of a valve 476*b* is controlled by the controller 477. The adoption of the above-described configuration enables control of the heat conductivity in the system by pressure in the container of the present invention.

A heat insulating member such as an insulating fire brick or the like is decreased in heat insulating performance with its aging. For example, when molten metal is transported using a plurality of containers, the temperatures of the molten metal are sometimes different from others due to individual difference of the container. The temperature of the molten metal may sometimes drop to a level at which requirements of a user are not suitable. As for the container of the present invention, it is possible to reduce the pressuree by the exhausting system the inside of the frame of, for example, a container in which a temperature drop of the molten metal is recognized during carriage, so as to suppress the heat conductivity of the inside to low. Thereby, the temperature of the molten metal can be kept irrespective of decrease in the heat insulating performance of the heat insulation. It is also possible to decrease the difference in temperature between the contents of the plurality of containers. Further, oxidation of the molten metal can also be prevented. The pressure control can be conducted through use of not temperature itself but of a rate of change (for example, a differential value) in temperature, which configuration enables more accurate temperature control of the molten metal.

Figure 18:
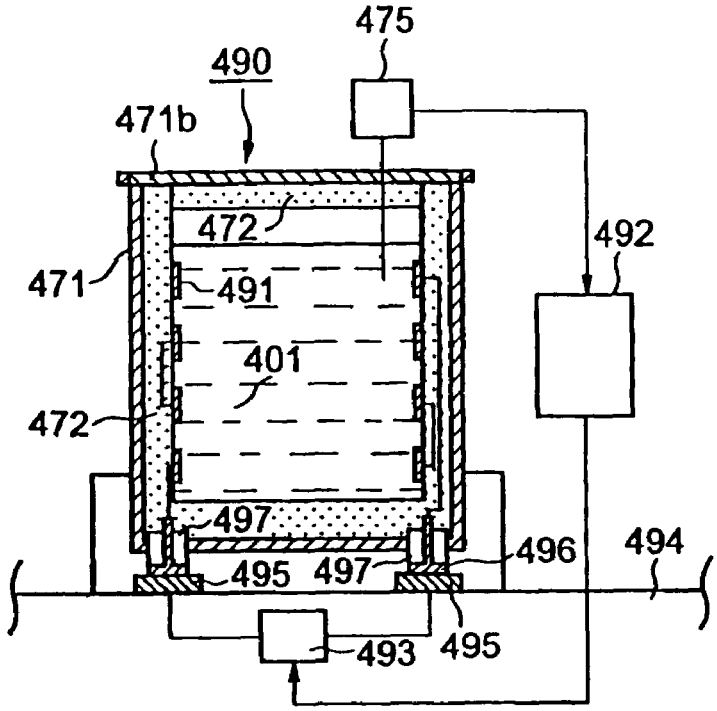
FIG. 18 is a view schematically showing another example of the configuration of the container of the present invention.
Figure 19:
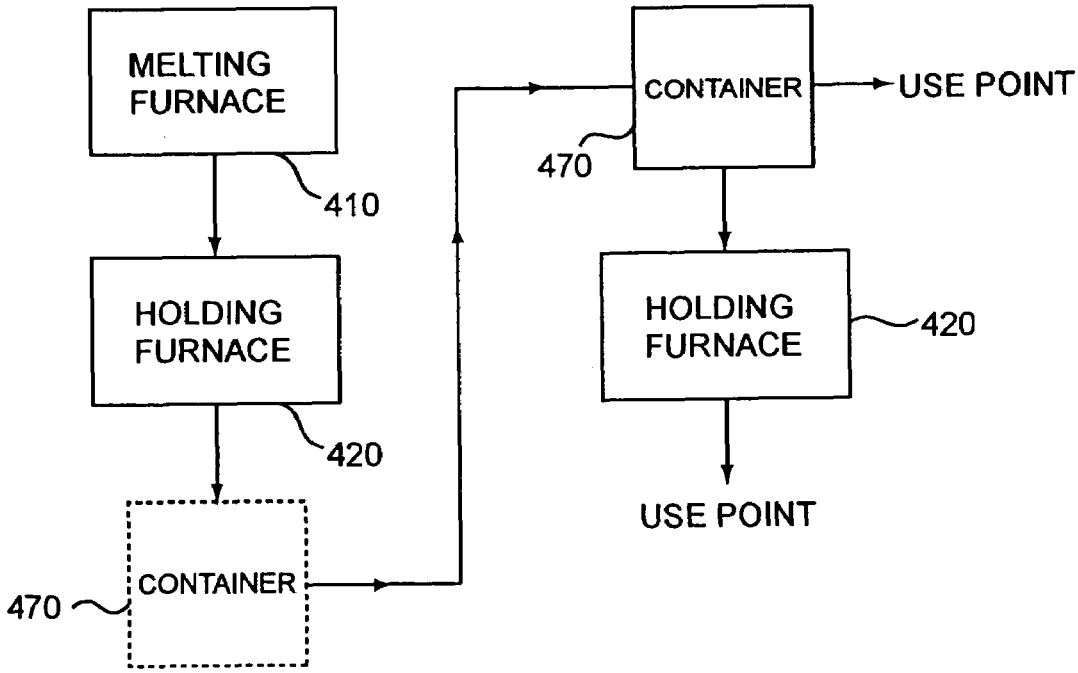
FIG. 19 is a diagram for explaining an example of a delivery model of metal using the supply apparatus and the container of the present invention.

FIG. 18 is a view schematically showing another example of the configuration of the container according to the present invention. This container 490 comprises a frame 471 and a lid 471*b* with a heat insulation 472 on their inner faces, a heater 491 disposed on the inside of the heat insulation 472, a temperature sensor 475 that measures the temperature of a molten metal 401, and a controller 492 that controls the heater 475 in accordance with the measured temperature or the rate of change in temperature. For example, the temperature of the metal 401 is appropriately managed by controlling a power supply 493 that supplies electric power to the heater 491 in accordance with the rate of change in the temperature measured by the temperature sensor 475. In this embodiment, airtightness of the container is not expected from a viewpoint of temperature management. It is of course preferable to control the pressure and the oxygen concentration of the inside. This should be conducted particularly when unstable metal is stored.

This example shows an appearance of the container 490 which is mounted on a loading platform of a truck or a ship. An electrode 495 is exposed on the loading platform 494 to ensure an electrical connection with an electrode 496 on the container side when the container is placed at a predetermined position. Numeral 497 denotes an insulating member such as an insulator. In this case, the power supply 493 can be mounted on the truck. Alternatively, it is also adoptable to share it with batteries of the truck. The adoption of such a configuration enables delivery and supply of high quality metal.

FIG. 15 is a diagram for explaining an example of a delivery model of metal using the supply apparatus and container of the present invention.

Figure 11:
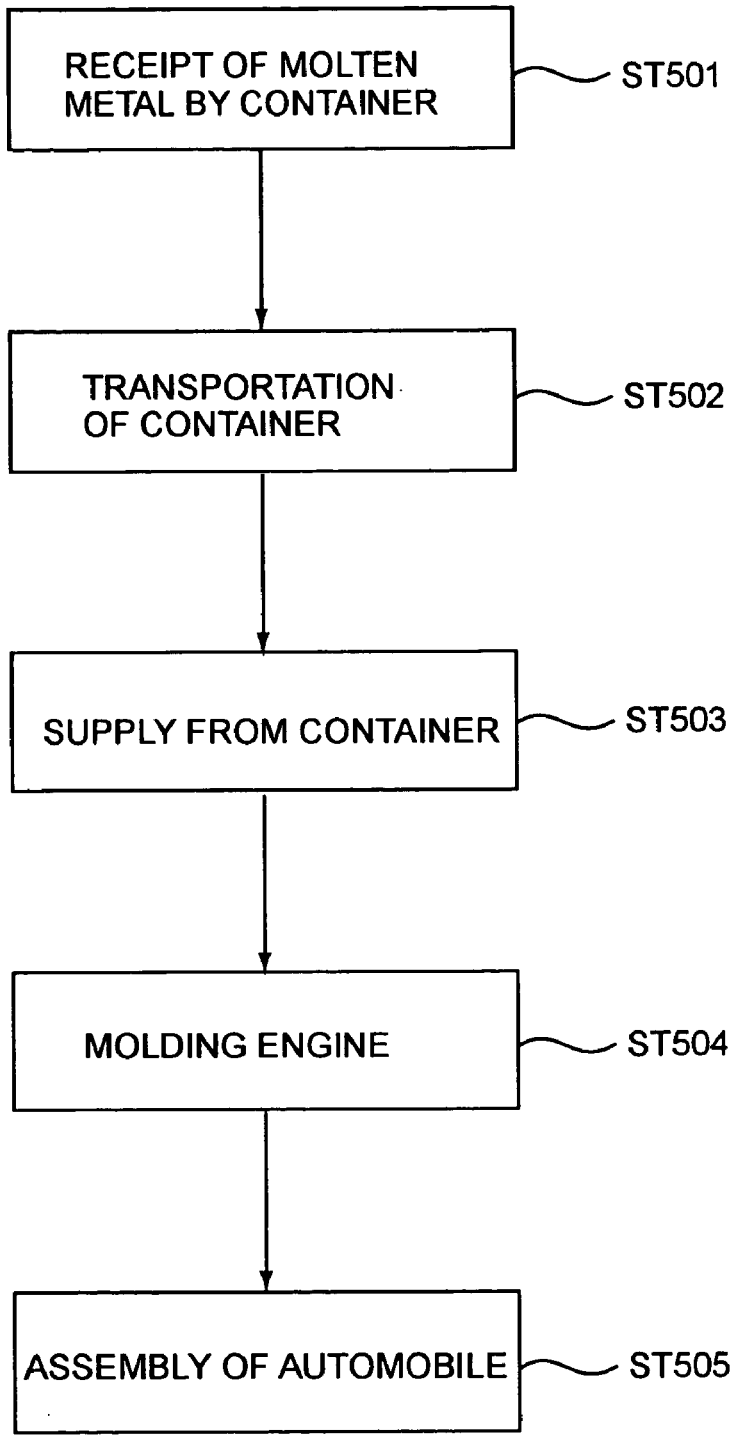
FIG. 11 is a flowchart showing a producing method of an automobile using the system of the present invention.

For example, in the case of using molten metal, there are about conceivable three aspects. The first one is a case in which the melting furnace or the storing furnace is provided near a use point, a factory with the molding apparatus, or the like. The second one is a case in which a small-size melting furnace is provided for every molding apparatus. The third one is a case in which metal is molten at a predetermined place and the molten metal is delivered to a use point. The present invention is applicable to any of the cases and provides improved quality, improved safety, improved productivity, and reduced energy cost. The aforementioned second case is conceivable as the most disadvantageous in a viewpoint of energy. In this case, it is only required to dispose near the use point the storing furnace 420 of the present invention or the container 470, 480, or 490 of the present invention, for example, as shown in FIG. 11. The metal is kept in a good state and delivered in safety. The above-described configuration considerably reduces the energy cost. Further, the configuration also eliminates the cost of the melting furnaces individually disposed at use points and the cost of installation space thereof.

INDUSTRIAL AVAILABILITY

As has been described, the present invention can provide a container requiring no replacement of parts such as a stoke and the like. Further, the present invention makes it possible to eliminate the work of removing oxide and so on to improve productivity. Furthermore, the present invention makes it possible to supply molten metal by applying the pressure or to load molten metal by reducing the pressure in the container. Moreover, the duration for supplying the molten metal can be shortened. In addition, the time required to stop supply of the molten metal can be shortened, resulting in improved safety.

The invention claimed is:

1. A molten metal supply container which is capable of being loaded on a fork of a forklift including a tank for storing a compressed gas and capable of being transported by the forklift, comprising:

a container which is capable of storing a molten metal and includes a first opening portion on an upper portion thereof;

a flow path which is communicated with inside/outside of the container and through which the molten metal is capable of being flowed;

a lid which is disposed to cover the first opening portion and includes a second opening portion approximately at a center thereof, the second opening portion having a smaller diameter than the first opening portion;

a hatch which is provided on an upper surface portion of the lid to be openable/closable and is provided with a passage through which the compressed gas for increasing pressure in the container is supplied from the tank into the container, the passage being communicated with the inside/outside of the container; and a pair of channel members which is provided to a bottom portion of the container and to/from which the fork is capable of being inserted/withdrawn.

2. A molten metal supply container according to claim 1, further comprising:

a pipe connecting the passage and extends to an upper direction from the upper portion of the container and bends and extends to a horizontal direction at a predetermined height.

3. A molten metal supply container according to claim 1, wherein the pipe is detachably screwed into the passage.

4. A molten metal supply container according to claim 1, wherein the passage is approximately at a center of the hatch.

* * * * *